US006042892A

United States Patent [19]

Kim et al.

[11] Patent Number: 6,042,892

[45] Date of Patent: Mar. 28, 2000

[54] APPARATUS FOR COATING ZINC ON STEEL SHEET, AND METHOD THEREFOR

[75] Inventors: Sang Hean Kim; Jin Hwan Chung; Noi Ha Cho, all of Kwangyang, Rep. of Korea

[73] Assignee: Pohang Iron & Steel Co., Ltd., Rep. of Korea

[21] Appl. No.: 09/091,644

[22] PCT Filed: Oct. 23, 1997

[86] PCT No.: PCT/KR97/00201

§ 371 Date: Jun. 19, 1998

§ 102(e) Date: Jun. 19, 1998

[87] PCT Pub. No.: WO98/18979

PCT Pub. Date: May 7, 1998

[30] Foreign Application Priority Data

Oct. 25, 1996 [KR] Rep. of Korea ..... 96-48227

[51] Int. Cl.[7] ..... B05D 1/06; B05D 1/24; B05C 19/02

[52] U.S. Cl. ..... 427/459; 427/461; 427/482; 427/185; 427/321; 427/376.8; 118/309; 118/634; 118/DIG. 5

[58] Field of Search ..... 427/458, 459, 427/461, 482, 185, 321, 376.8; 118/DIG. 5, 308, 309, 634

[56] References Cited

U.S. PATENT DOCUMENTS

| | | | |
|---|---|---|---|
| 3,019,126 | 1/1962 | Bartholomew . | |
| 3,724,416 | 4/1973 | Diamond et al. . | |
| 4,301,764 | 11/1981 | Campian et al. . | |
| 5,208,077 | 5/1993 | Proctor et al. . | |
| 5,384,165 | 1/1995 | Sellitto . | |
| 5,551,981 | 9/1996 | Sellitto | 118/621 |

FOREIGN PATENT DOCUMENTS

| | | |
|---|---|---|
| 866153 | 3/1971 | Canada . |
| 5311388 | 6/1992 | Japan . |
| WO9429030 | 12/1994 | WIPO . |

*Primary Examiner*—Fred J. Parker
*Attorney, Agent, or Firm*—Webb Ziesenheim Logsdon Orkin & Hanson, P.C.

[57] ABSTRACT

An apparatus and a method for coating zinc on steel sheets for use on automobiles and electronic apparatuses are disclosed. A fluidized bed forming chamber is provided to fluidize zinc powders in carrying out a zinc coating on a heated steel sheet, so that not only a uniformly coated layer but also a thick coated layer can be obtained. The apparatus for continuously coating zinc on a steel sheet according to the present invention includes a zinc coating chamber for forming a fluidized bed of zinc powders, for passing a heated steel sheet through the fluidized bed of the zinc powders, and for making the zinc powders melt-adhere on the steel sheet during its passing through the fluidized bed. A fluidized bed forming chamber forms a fluidized bed of the zinc powders by making the zinc powders suspended by spouting a gas. A cyclone separates the zinc powders from the gas after recovery of them from the zinc coating chamber, to discharge the gas, and to return the separated zinc powders to the fluidized bed forming chamber. A deflector shifts the advancing direction of the steel sheet after its admittance into the zinc coating chamber. A tension roll shifts the advancing direction of a zinc coated steel sheet. Further, the zinc coating chamber includes one or more electrodes for electrostatically charging the zinc powders.

54 Claims, 8 Drawing Sheets

APPARATUS FOR COATING ZINC ON STEEL SHEET, AND METHOD THEREFOR

BACKGROUND OF THE INVENTION

The present invention relates to an apparatus and a method for coating zinc on steel sheets for use on automobiles and electronic apparatuses. More specifically, the present invention relates to an apparatus and a method for coating zinc on steel sheets by using zinc powders.

Zinc performs a sacrificing action for steel to extend the life expectancy of steel, and therefore, conventionally zinc has been used in zinc-coating a steel sheet. There are many kinds of zinc coating methods such as hot dip galvanization, electroplating, and zinc powder-using zinc coating. The zinc coated steel sheets are mostly used as automobile body sheets and outer and inner sheets of electronic apparatuses. They are manufactured by electroplating or hot dip galvanization. The reason is as follows. That is, when a steel strip is continuously coated, not only the product quality but also the productivity and the workability have to be considered. In this respect, electroplating and hot dip galvanization are advantageous.

Electroplating is carried out in the following manner. That is, cold rolled steel sheets are made to undergo a batch annealing or a continuous annealing so as to improve mechanical properties. Then, electroplating is carried out within an electrolyte containing zinc ions, thereby obtaining a zinc deposition layer of the target thickness. In this method, the mechanical properties which have been obtained through heat treatments are not degraded during the plating process. Further, the coated amount (deposition thickness) is varied in accordance with the applied electric power, and therefore, the coated amount can be accurately controlled.

However, it has the following disadvantages. That is, as the coated amount is increased, much more electric power is required. Consequently, the productivity is aggravated in the case of a thick plating. Therefore, electroplating is adopted in the case where the coated amount is 40 g/m$^2$ or less for one face of the steel sheets. Meanwhile, the plating speed is limited by the current density limit, and therefore, if the productivity is to be improved, the zinc coating chamber has to be long. This becomes a facility burden. Because of such limiting factors, electroplating should be preferably carried out at a strip velocity of about 200 m/min and at a coated amount of 40 g/m$^2$ or less for one face of the steel sheet.

Meanwhile, hot dip galvanization is carried out in the same facility as that of the annealing. Therefore the manufacturing cost becomes lower, and a thick zinc coating is possible. However, it has the following disadvantages. That is, a sink roll and a guide roll which are immersed in a hot dipping pot are corroded, and therefore, they have to be replaced periodically. Further, as the line speed becomes fast, the resistivity of the melted zinc is increased. Therefore, the sink roll cannot move synchronously with the steel sheet to produce slips, and therefore, the surface of the steel sheet may be scratched so much as to lead to a product defect. Further, as the line speed is increased, or as the coated thickness is decreased, splashes are increased during an air wiping, with the result that the generation of dross is increased. Besides, if the zinc adhered on the surface is to be solidified, some cooling period is required, and therefore, the velocity of the steel sheet is limited to about 200 m/min. Further, the adjustment of the coated thickness is difficult, and therefore, the manufacturing becomes difficult if the coated amount per face is less than 40 g/m$^2$.

A method for coating zinc by using zinc powders is disclosed in Japanese Patent Application Laid-open No. Hei-5-311388.

This method is illustrated in FIG. 1. As shown in this drawing, an object to be coated (steel sheet) 1 is heated to above the melting point of the powder metal, and zinc powders loaded on a gas are spouted by means of a spouting nozzle 6 onto the object 1 within a zinc coating chamber 3 containing a reducing atmosphere. Thus the zinc powders are melt-adhered on the steel sheet 1, thereby zinc-coating the steel sheet.

In FIG. 1, reference codes 4 and 5 indicate sealing devices.

In this method, a reducing atmosphere is used, and therefore, a flux does not have to be used. Further, compared with the hot dip galvanization, the air wiping and the management of the melt composition are not required, and the dross generation does not occur. However, in the case of Japanese Patent Application Laid-open No. Hei-5-311388, the zinc powders from the powder storage chamber are not screened but directly pouted into-the zinc coating chamber. Therefore, large articles and coarse secondary particles can adhere on the steel sheet, with the result that the coated layer becomes irregular.

Meanwhile, another zinc coating method is disclosed in which an object to be coated is heated to 775° F. (413° C.) –820° F. (438° C.), and zinc powders or a zinc melt is spouted, so that zinc would be coated on steel sheets (CA 866153 (7113).

In this method, however, a flux is spouted together with the zinc powders to prevent the oxidation of the steel sheet. Further, in order to improve the adherence of zinc, electrostatic charges of opposite polarities are provided on the zinc powders and the object to be coated.

In this method, owing to the mechanical spouting force and the electrostatic attractions, a large coated amount can be easily obtained. Further, it can be applied to a complicated steel structure, but when it is applied to a continuous zinc coating of a steel strip, the following problems occur. (1) The high voltage electrostatic charges of opposite polarities are dangerous to workers. (2) There are necessarily loosely adhered zinc particles after the zinc coating, and these particles adhere on various rolls to cause defects called "dent". (3) Zinc powders are released into the external air to aggravate the working environment.

Further, there are other disclosures in which electrostatic charges are utilized in coating zinc powders (U.S. Pat. Nos. 5,384,165 and 5,551,981).

In these methods, zinc powders are made to adhere on steel sheets by utilizing electrostatic charges, and then, the steel sheets are heated to convert the adhered zinc powders to a coated layer.

The apparatus for these methods is illustrated in FIG. 2. As shown in this drawing, the apparatus includes a fluidized bed 18 of zinc powders, and a cooling device 24 and a heating device 21 disposed above the fluidized bed 18. A steel sheet immersed in fluidized bed 18 is made to shift its advancing direction upward to be heated by the heating device 21, so that the zinc powders would be melted. The melted zinc powders are reflowed, and then are cooled.

In FIG. 2, reference code 10 indicates a housing, 16 indicates a strip bending roll, 17 indicates a fall space, 17A indicates a plate as a part of an electrostatic charge circuit, 17B indicates a controller, 20 indicates a top deflector roll.

In these U.S. patents, steel sheets can be coated without much modification to the existing melting facility, but have the following disadvantages.

(1) When the electrostatically charged metal powders contact with the steel sheet, the surface charges are transferred to the steel sheet so as to be grounded and to disappear. Therefore, the attractive force of the electrostatic charges which is to act as the adhering force between the steel sheet and the zinc powder is dissipated. Therefore, the zinc powders depart from the surface of the steel sheet, and therefore, there is a limit in the increase of the coated thickness.

(2) The roller is immersed in the fluidized bed of zinc powders, and therefore, when the steel sheet moves, the zinc powders intrude in between the roller and the steel sheet, so that the zinc powders may adhere on the roller. Particularly, zinc powders speedily undergo sintering reactions above 250° C. Therefore, the zinc powders which have intruded in between the steel sheet and the roller undergo a sintering reaction owing to the latent heat of the steel sheet. As a result, coarse particles may be formed, and the dent phenomenon becomes more serious.

(3) The fine zinc particles of 5–15 $\mu$m which are used in the above patents are not well fluidized, but agglomerations occur. Therefore, the zinc particles of the fluidized bed are liable to be irregular, and therefore, if the steel sheet is put into the fluidized bed, a uniform coated layer cannot be obtained.

Further, if a reflowing is carried out after the adherence of the zinc powders, a volume contraction occurs as in the case of the powder metallurgy. Therefore, the coated layer may look as if the steel sheet has cracked. Further, if the reflowing is imperfectly carried out, the residual zinc powders of the surface will adhere on the roller so as to form a dent defect.

SUMMARY OF THE INVENTION

In order to solve the above described disadvantages of the conventional techniques, the present inventors carried out research and studies, and based on the result of the research and studies, the present inventors propose the present invention.

Therefore it is an object of the present invention to provide a zinc coating apparatus and a method therefor, in which a fluidized bed forming chamber is provided to fluidize zinc powders in carrying out a zinc coating on a heated steel sheet, so that not only a uniformly coated layer but also a thick coated layer can be obtained.

It is another object of the present invention to provide a zinc coating apparatus and a method therefor, in which a fluidized bed forming chamber is provided to fluidize zinc powders, and the fluidized zinc powders are electrostatically charged to coat zinc on a heated steel sheet, so that not only a uniformly coated layer but also a thick coated layer can be obtained, and that an aesthetically superior coated layer can be obtained.

In achieving the above objects, the apparatus for continuously coating zinc on a steel sheet according to the present invention includes:

a zinc coating chamber for forming a fluidized bed of zinc powders, for passing a heated steel sheet through the fluidized bed of the zinc powders, and for making the zinc powders melt-adhere on the steel sheet during the passing of the steel sheet through the fluidized bed;

a fluidized bed forming chamber for forming a fluidized bed of the zinc powders by making the zinc powders suspended by spouting a gas;

a cyclone for separating the zinc powders from the gas after recovery of them from the zinc coating chamber, to discharge the gas, and to return the separated zinc powders to the fluidized bed forming chamber;

a deflector for shifting the advancing direction of the steel sheet after its admittance into the zinc coating chamber;

a tension roll for shifting the advancing direction of a zinc coated steel sheet;

the zinc coating chamber including: a powder inlet tube connected from a side wall of the zinc coating chamber to the fluidized bed to inject the zinc powders into the zinc coating chamber; a gas inlet tube for forming a turbulent flow of the zinc powders and for preventing a leakage of the zinc powders; and a recovering tube for reusing uncoated zinc powders;

the gas inlet tube being disposed above the powder inlet tube, and the recovering tube being disposed below the powder inlet tube;

the recovering tube being connected between the zinc coating chamber and the cyclone, and a suction pump being connected to the cyclone;

a separating plate provided within the zinc coating chamber, for making the uncoated zinc powders smoothly flow to the recovering tube, and for preventing the zinc powders from flowing into the zinc coating chamber after passing through the recovering tube; and a stabilizing roll disposed below the separating plate.

In another aspect of the present invention, the apparatus for continuously coating zinc on a steel sheet according to the present invention includes:

a zinc coating chamber for making zinc powders melt-adhere on a heated steel sheet to form a coated layer;

a fluidized bed forming chamber for forming a fluidized bed of the zinc powders by making the zinc powders suspended by spouting a gas;

a cyclone for separating the zinc powders from the gas after recovery of them from the zinc coating chamber, to discharge the gas, and to return the separated zinc powders to the fluidized bed forming chamber;

a deflector roll for shifting the advancing direction of the steel sheet after its admittance into the zinc coating chamber;

a tension roll for shifting the advancing direction of a zinc coated steel sheet;

the zinc coating chamber including a powder spouting tube connected from a side wall of the zinc coating chamber to the fluidized bed to spout the zinc powders into the zinc coating chamber;

the zinc coating chamber further including a recovering tube connected to the cyclone, for recovering uncoated zinc powders; and one or more of electrodes provided in the zinc coating chamber, for electrostatically charging the zinc powders, the electrodes being connected to a high voltage generating device.

In still another aspect of the present invention, the method for continuously coating zinc on a steel sheet by making the steel sheet pass through a zinc coating chamber according to the present invention, includes the steps of:

supplying fluidized zinc powders of a fluidized bed to the zinc coating chamber, and injecting an inert gas or a reducing gas into the zinc coating chamber through a side wall of the zinc coating chamber to form a fluidized bed within the zinc coating chamber;

making a heated steel sheet (heated to 420–730° C.) through the fluidized bed within the zinc coating chamber to melt-attach the zinc powders on the steel sheet so as to form a coated layer;

reheating the zinc powder-adhered steel sheet at a temperature of 420–650° C. for 1–20 seconds to make residual uncoated zinc powders melt-adhered on the surface of the steel sheet so as to form a coated layer; and discharging residual uncoated zinc powders from a bottom portion of the zinc coating chamber together with a gas by a cyclone, to separate the zinc powders from the gas so as to discharge the gas and so as to return the separated zinc powders to a fluidized bed forming chamber.

In still another aspect of the present invention, the method for continuously coating zinc on a steel sheet by making the steel sheet pass through a zinc coating chamber according to the present invention, includes the steps of:

receiving zinc powders from a powder supply device, and fluidizing the zinc powders within a fluidized bed forming chamber by a help of a gas blown through a lower portion;

injecting the fluidized zinc powders from the fluidized bed forming chamber to a zinc coating chamber by means of an injecting device to form a fluidized bed within the zinc coating chamber;

charging the zinc powders of the fluidized bed positively or negatively;

heating a steel sheet to 420–730° C. and grounding the steel sheet, and making the charged steel sheet pass through the fluidized bed to make the zinc powders melt-adhere on the steel sheet;

sending residual zinc powders of a bottom portion of the zinc coating chamber to a cyclone together with a gas to separate the zinc powders from the gas, so as to discharge the gas, and so as to return the separated zinc powders to a powder supply device.

The above method further includes the step of: forming a coated layer by melt-coating the zinc powders on the steel sheet, and then, carrying out a reheating at a temperature of 420–650° C. for 1–20 seconds to make residual uncoated zinc powders melt-adhere on the steel sheet.

BRIEF DESCRIPTION OF THE DRAWINGS

The above objects and other advantages of the present invention will become more apparent by describing in detail the preferred embodiment of the present invention with reference to the attached drawings in which.

DETAILED DESCRIPTION OF THE INVENTION

Figure 1:
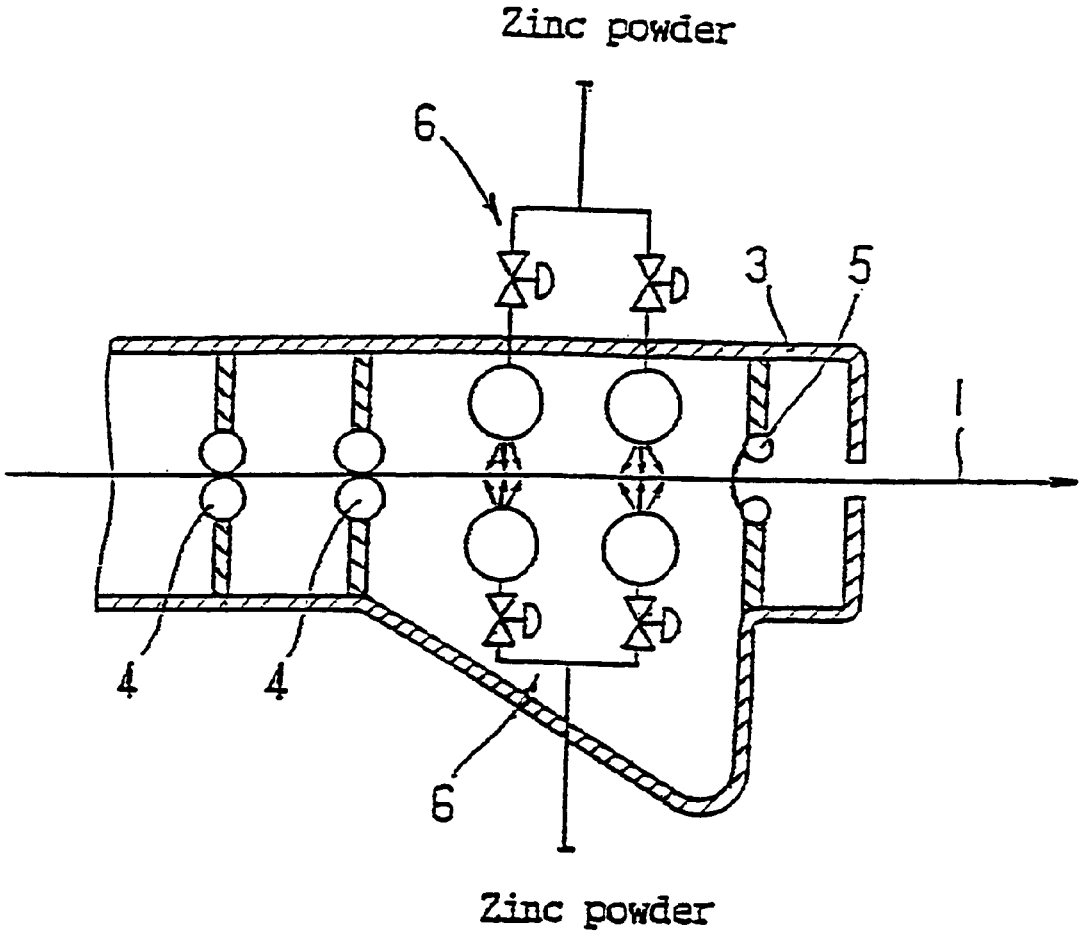
FIG.1 PRIOR ART
FIG. 1 is a schematic illustration of a conventional zinc coating apparatus.
Figure 2:
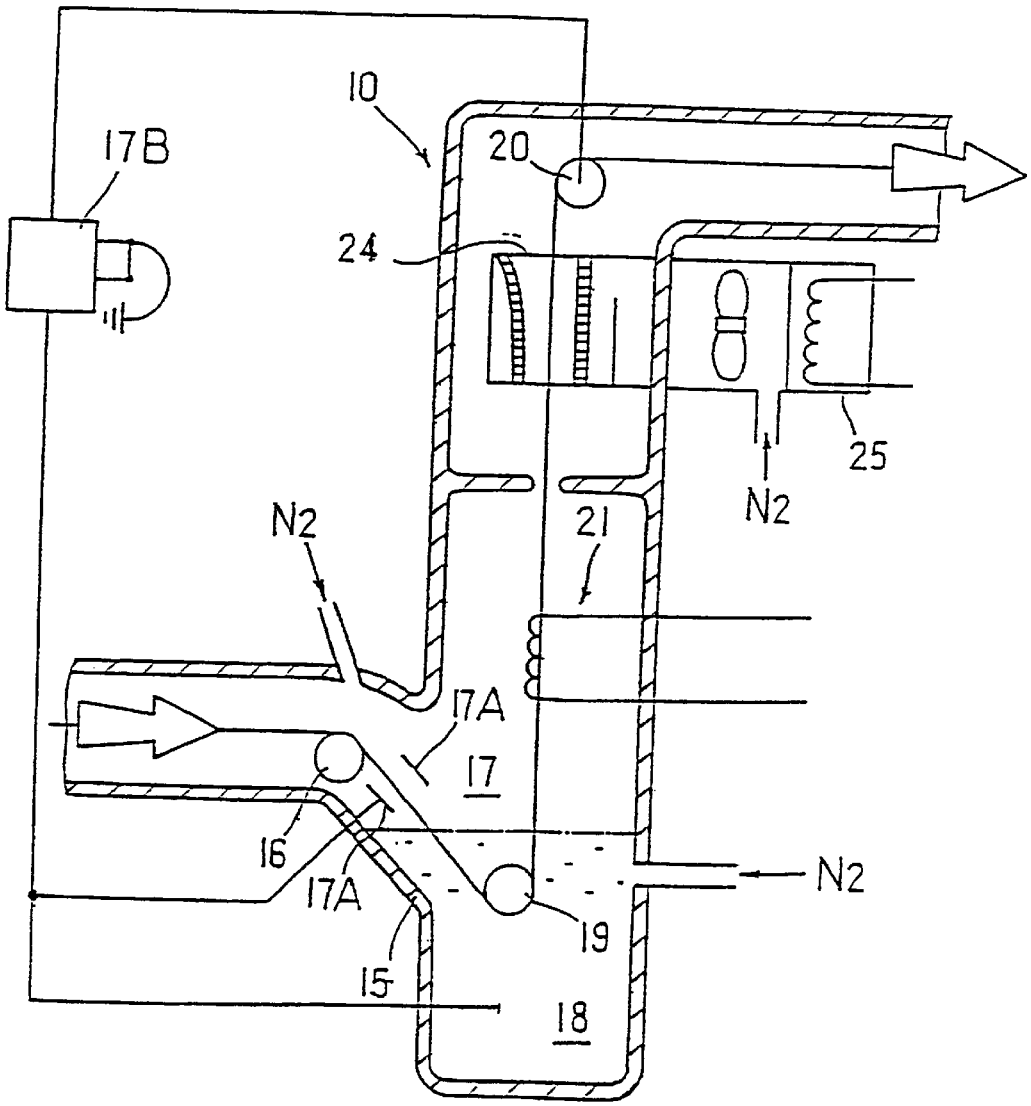
FIG.2 PRIOR ART
FIG. 2 is a schematic illustration of another conventional zinc coating apparatus.
Figure 3:
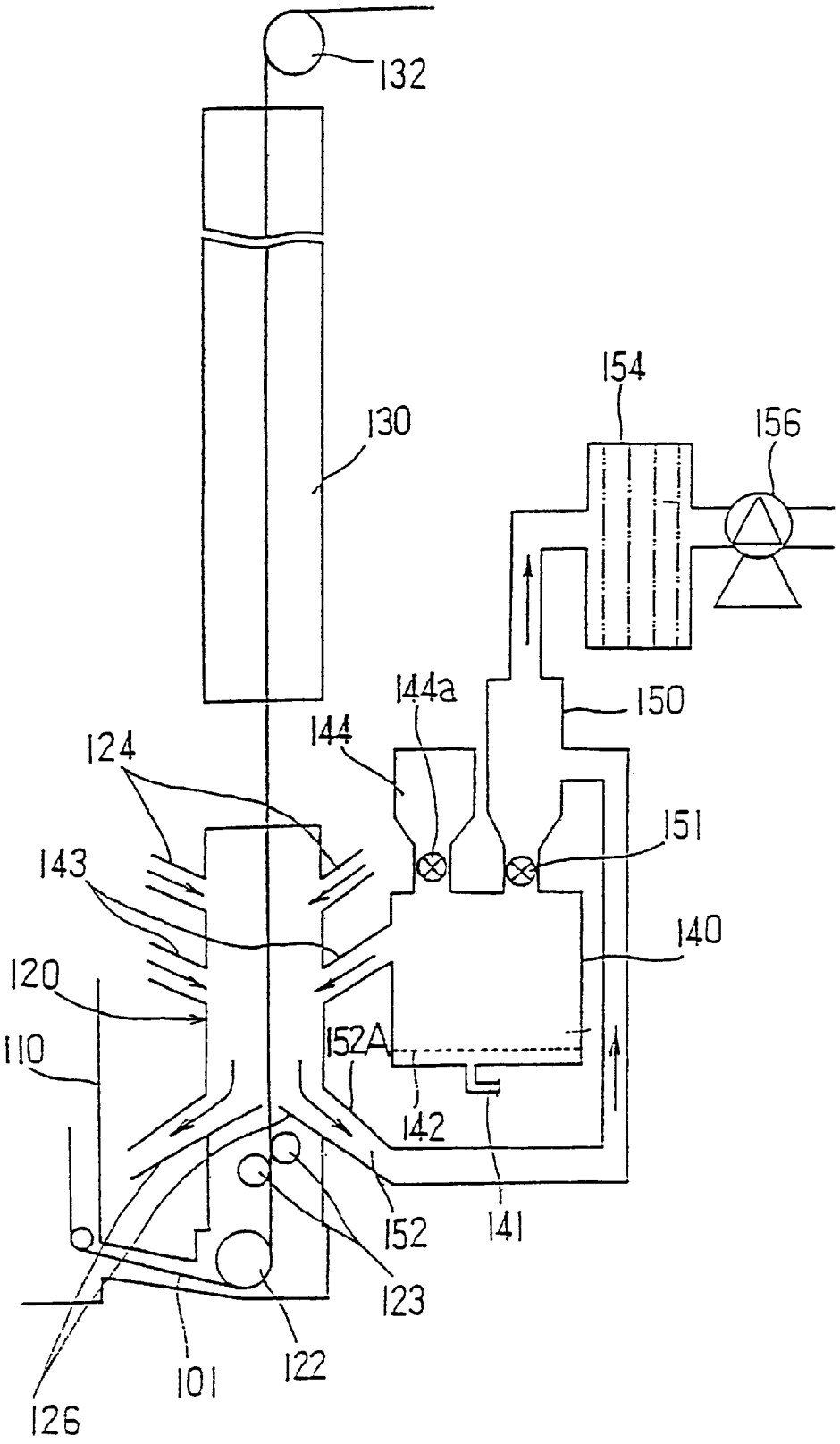
FIG. 3 illustrates an embodiment of the zinc coating apparatus according to the present invention.

FIG. 3 illustrates a first embodiment of the zinc coating apparatus according to the present invention.

As shown in this drawing, the apparatus includes:

a zinc coating chamber 120 for forming a fluidized bed of zinc powders, for passing a heated steel sheet (steel strip) 101 through the fluidized bed of the zinc powders, and for making the zinc powders melt-adhere on the steel sheet during the passing of the steel sheet through the fluidized bed;

a fluidized bed forming chamber 140 for forming a fluidized bed of the zinc powders by making the zinc powders suspended by spouting a gas;

a cyclone 150 for separating the zinc powders from the gas after recovery of them from the zinc coating chamber 120, to discharge the gas, and to return the separated zinc powders to the fluidized bed forming chamber 140;

a deflector 122 for shifting the advancing direction of the steel sheet after its admittance into the zinc coating chamber 120; and a tension roll 132 for shifting the advancing direction of a zinc coated steel sheet.

A means for heating the steel sheet may be an annealing furnace 110 as shown in FIG. 3.

The zinc coating chamber includes a powder spouting tube 143 connected from a side wall of the zinc coating chamber 120 to the fluidized bed forming chamber 140 to inject the fluidized zinc powders into the zinc coating chamber 120.

Further, on a side wall of the zinc coating chamber 120, there is provided a gas inlet tube 124 for forming a turbulent flow of the zinc powders and for preventing a leakage of the zinc powders. The zinc powders are supplied from a powder supply tube 143, and the gas inlet tube 124 is disposed above the powder supply tube 143.

On a side wall of the zinc coating chamber 120, there is further connected a recovering tube 152 for sending uncoated and descending-zinc powders and the gas to the cyclone 150.

The recovering tube 152 should preferably include an inclined portion 152A, and this inclined portion 152A should be constituted such that it can facilitate the recovery of the zinc powders.

The zinc coating chamber 120 includes a separating plate 126. This separating plate 126 makes the uncoated zinc powders flow smoothly to the recovering tube 152, and prevents the zinc powders from flowing through a recovering tube connecting portion to the lower portion of the zinc coating chamber 120.

Beneath the separating plate 126, there is disposed a stabilizing roll 123.

The upper portion of the fluidized bed forming chamber 140 is connected to a hopper 144 which supplies the zinc powders. To the bottom of the fluidized bed forming chamber 140, there is connected a gas supply tube 141 which is connected to a gas supply source (not shown in the drawings). Below the fluidized bed forming chamber 140, there can be disposed a porous gas dispersing plate 142 which disperses the gas from the gas supply tube 141 to obtain a uniform fluidized bed.

The fluidized bed forming chamber 140 and the cyclone 150 can be provided in the number of one or more. In the present invention, even if a single fluidized bed forming chamber 140 is installed, a plurality of powder inputting tubes 143 can be connected to it, so that the zinc powders can be inputted into the zinc coating chamber 120 from a plurality of points.

The cyclone 150 is connected to a suction pump 156, and the suction pump 156 sucks the uncoated zinc powders and the gas from the zinc coating chamber 120.

A filter 154 should be preferably installed between the cyclone 150 and the suction pump 156, so that the zinc powders remaining in the gas after the gas-powder separation by the cyclone 150 can be captured.

The uncoated zinc powders remaining on the coated surface of the steel sheet should be converted into a zinc coated layer. For this purpose, the coated steel sheet is heated. In order to carry out the heating, a reheating furnace 130 should be preferably installed between the zinc coating chamber 120 and the tension roll 132.

Valves 144*a* and 151 are installed respectively under the hopper 144 and the cyclone 150.

Figure 4:
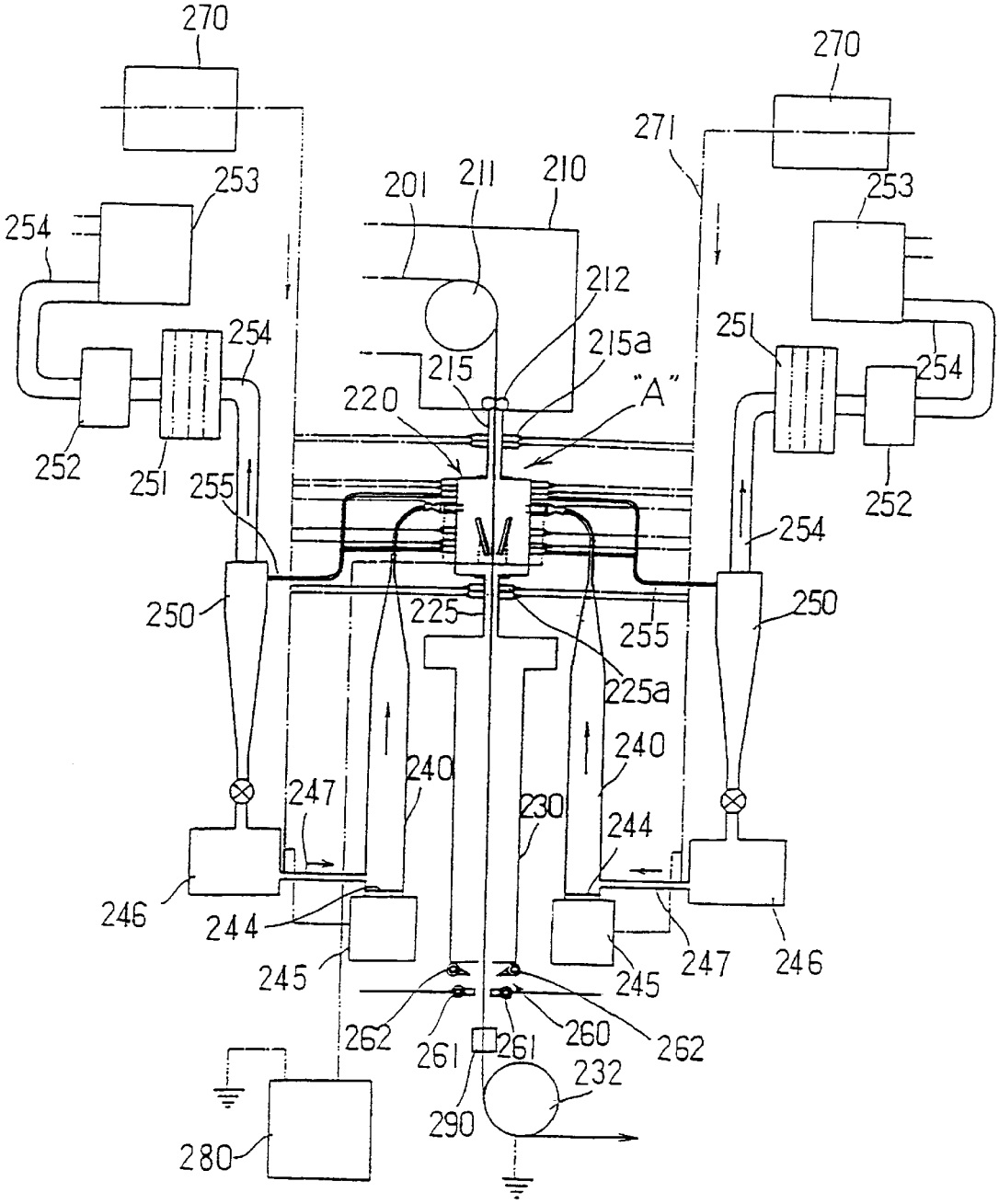
FIG. 4 illustrates another embodiment of the zinc coating apparatus according to the present invention.

In another embodiment of the present invention, the apparatus for continuously coating zinc on a steel sheet according to the present invention as shown in FIG. 4 includes:

- a zinc coating chamber 220 for making zinc powders melt-adhere on a heated steel sheet (strip) 201 to form a coated layer;
- a fluidized bed forming chamber 240 for forming a fluidized bed of the zinc powders by making the zinc powders suspended by spouting a gas;
- a cyclone 250 for separating the zinc powders from the gas after recovery of them from the zinc coating chamber 220, to discharge the gas, and to return the separated zinc powders to the fluidized bed forming chamber 240;
- a deflector 211 for shifting the advancing direction of the steel sheet after its admittance into the zinc coating chamber 220; and
- a tension roll 232 for shifting the advancing direction of a zinc coated steel sheet.

The means for heating the steel sheet may consist of an annealing furnace 210 as shown in FIG. 4.

The zinc coating chamber 220 includes a powder spouting device 223 connected from a side wall of the zinc coating chamber 220 to the fluidized bed forming chamber 240 to spout the zinc powders into the zinc coating chamber 220.

The powder spouting device 223 should preferably include: a powder carrying tube 223*c* connected to the fluidized bed forming chamber 240; an injection pump 223*b* connected to the powder carrying tube 223*c;* and a powder spouting nozzle 223*a* for spouting the zinc powders from the injection pump 223*b* into the zinc coating chamber 220.

The powder spouting device 223 is installed in the number of two on the opposite side walls of the zinc coating chamber 220.

Further, the zinc coating chamber 220 should be provided with one or more of electrodes for electrostatically charging the zinc powders.

Figure 5:
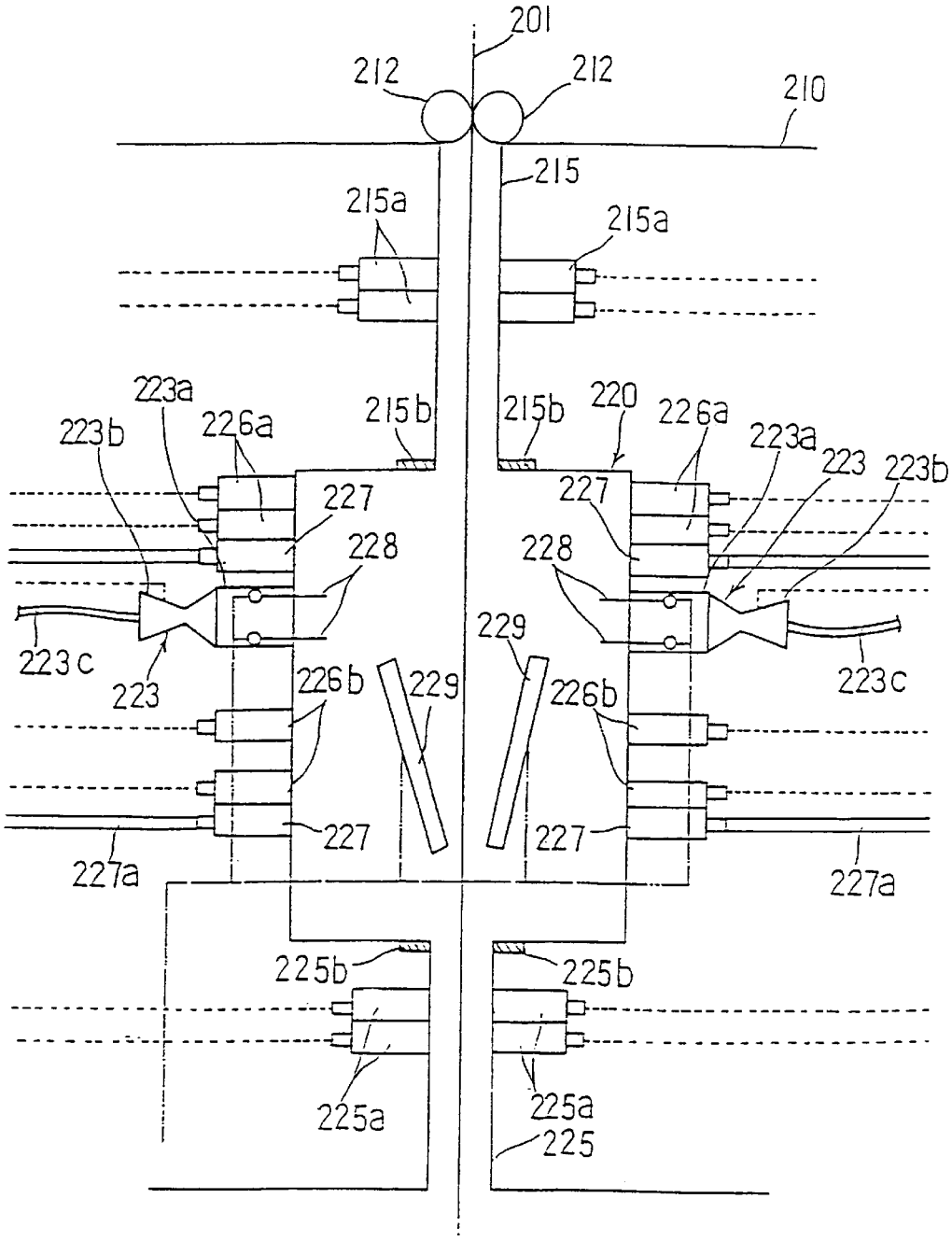
FIG. 5 is a detailed illustration of a portion A of FIG. 4.

As shown in FIG. 5, a pair of sharp electrodes 228 should be preferably provided on the sides walls of the zinc coating chamber 220 oppositely facing. More preferably, a pair of the sharp electrodes 228 should be provided on the side walls of the zinc coating chamber 220, and at the same time, a pair of net type electrodes 229 should be provided both facing across the advancing steel sheet within the zinc coating chamber 220.

These electrodes are connected to a high voltage generator 280.

These electrodes are for electrostatically charging the zinc powders with negative or positive charges.

A recovering tube 227 which is connected to the cyclone 250 is also connected to a lower portion of the side wall of the zinc coating chamber 220, for recovering the uncoated zinc powders. The recovering tube 227 can be connected not only to the zinc coating chamber 220 but also to an upper portion of the side wall of the powder spouting device 223.

An upper sealing chamber 215 is installed between the annealing furnace 210 and the zinc coating chamber 220, while a lower sealing chamber 225 is installed between the zinc coating chamber 220 and the reheating furnace 230.

The upper sealing chamber 215 communicates to the zinc coating chamber 220. The isolation between the annealing furnace 210 and the zinc coating chamber 220 should preferably be done by a pair of sealing rolls 212 which prevent lateral oscillations of the steel sheet, electrically ground the steel sheet, and seal the atmosphere of the annealing furnace 210.

A pair or more of gas spouting nozzles 215*a* should be preferably provided on the upper sealing chamber 215, so that the zinc powders can be prevented from floating up to the sealing roll 212, and that the internal pressure of the zinc coating chamber 220 can be adjusted.

The lower sealing chamber 225 should be preferably provided with a pair or more of gas spouting nozzles 225*a* to inject an atmospheric gas so as to adjust the internal pressure of the zinc coating chamber 220.

The upper sealing chamber 215 and the zinc coating chamber 220 should be insulated from each other by means of an insulator 215*b*. The lower sealing chamber 225 and the zinc coating chamber 220 should be insulated from each other by means of an insulator 225*b*.

If the insulators are provided as described above, then the walls of the zinc coating chamber are charged with the same polarity as that of the zinc powders, and therefore, the zinc powders can be prevented from being adhered on the walls of the zinc coating chamber.

Within the zinc coating chamber, the flow of the zinc powders should be prevented from being lamella within the internal atmosphere. For this purpose, a pair or more of gas spouting nozzles 226*a* should be preferably installed on the upper portion of the side wall of the zinc coating chamber 220. Further, a pair or more of gas spouting nozzles 226*b* should be preferably installed on the side wall of the zinc coating chamber 220 between the powder spouting nozzle 223 and the powder recovering tube 227.

As shown in FIG. 4, a gas discharge tube 254 is connected to the top of the cyclone 250, and the gas discharge tube 254 is connected to a suction pump 253 which transfers the gas and the uncoated zinc powders from the zinc coating chamber 220 to the cyclone 250.

The gas discharge tube 254 includes a back filter 251 and a dust collector 252, and the back filter 251 filters the discharge gas, while the dust collector 252 collects fine zinc powders after their passing through the back filter 251.

Meanwhile, the bottom of the cyclone 250 communicates to the powder supply device 246, and therefore, the zinc powders which have been separated from the gas are carried to the powder supply device 246.

The lower side wall of the fluidized bed forming chamber 240 is connected to the powder supply device 246 through the powder supply tube 247, so that the zinc powders can be supplied to the fluidized bed forming chamber 240. A gas supply part 245 is connected to the bottom of the fluidized bed forming chamber 240, for supplying the fluidizing gas to the fluidized bed forming chamber 240.

A porous gas dispersing plate 244 should be preferably installed in the lower portion of the fluidized bed forming chamber 240, so that the gas supplied from the gas supply part 245 can be uniformly dispersed.

The fluidized bed forming chamber 240 and the cyclone 250 can be provided in the number of one or more.

In the present invention, even in the case where a single fluidized bed forming chamber 240 is installed, a plurality of the powder spouting device 223 can be connected to the fluidized bed forming chamber 240, so that the zinc powders can be spouting from a plurality of points into the zinc coating chamber 220.

A reheating furnace 230 should be preferably installed between the zinc coating chamber 220 and the tension roll 232, so that the coated steel sheet can be reheated, and that the residual zinc powders can be converted into a coated layer.

Meanwhile, in the case where the reheating furnace 230 is installed beneath the zinc coating chamber 220, a cooling device 260 can be installed beneath the reheating furnace 230. This cooling device 260 should preferably consist of an air spouting nozzle 262 for forming an air curtain above a water spouting nozzle 261.

A washing device 290 having a brush for washing the surface of the steel sheet can be installed beneath the water spouting nozzle 261 of the cooling device 260. In the case where this washing device 290 is installed, the residual zinc powders are removed from the surface of the steel sheet, and therefore, the workability is improved.

Further, in the case where the reheating furnace 230 is installed, a holding chamber can be installed, so that the temperature of the steel sheet under the reheating furnace can be maintained at 500–650° C. to subject the coated layer to an alloying treatment.

Meanwhile, in the present invention, a gas heating device 270 should be preferably installed to heat the supplied gas to a certain temperature level.

Now the operation of the zinc coating apparatus of the present invention will be described referring to FIGS. 4 and 5.

First, the steel sheet 201 is heat-treated in the annealing furnace 210, and the temperature of the steel sheet is adjusted to 420–730° C. This steel sheet enters into the zinc coating chamber 220 by the help of the deflector roll 211 and the tension roll 232. Meanwhile, the zinc powders are supplied from the powder supply device 246 through the powder supply tube 247 into the fluidized bed forming chamber 240 to be suspended there. Then the zinc powders are transferred through the powder carrying tube 223*c*, the injection pump 223*b* and the powder spouting nozzle 223*a* into the zinc coating chamber 220. Then the zinc powders are first charged by an electrode 228 which is disposed near the powder spouting nozzle 223*a* so as to adhere on the steel sheet. Owing to a nitrogen gas or nitrogen-hydrogen gas mixture which is spouted through the gas spouting nozzle 226*b* of the zinc coating chamber 220, layered flows are prevented. Further, the zinc powders are completely charged by the net type electrode 229, with the result that the adhering efficiency is improved. Under this condition, the gas and the residual uncoated zinc powders are sucked into the recovering tube 227 so as to double the turbulent flow effect. In order to improve the efficiency of the flow of the zinc powders, the pressure and the flow rate of the fluidized carrier gas and the auxiliary gas of the venturi tube are properly adjusted. The coated amount during the zinc coating is adjusted by the supplied amount of the zinc powders, by the amount of the gas spouted into the fluidized bed and the venturi tube, and by the voltage supplied to the electrode.

The residual zinc powders after the zinc coating are discharged through the recovering tube 227 and the gas discharge tube 254 to the outside of the zinc coating chamber 220 by the suction pump 253. Then they are transferred to the cyclone 250, and are separated into the gas and the zinc powders. The separated zinc powders are reinputted through a valve into the powder supply device, while the separated gas is discharged through the back filter 251 and the dust collector 252. In order to prevent the zinc powders from being mixed into the annealing furnace 210, a nitrogen or nitrogen-hydrogen mixture gas is spouted through the gas spouting nozzle 215*a* of the upper sealing chamber 215 so as to form a gas curtain, and to adjust the internal pressure of the zinc coating chamber 220. Further, the oscillations of the steel sheet have to be prevented, the steel sheet has to be grounded, and the atmospheres of the annealing furnace 210 and the zinc coating chamber 220 have to be isolated from each other. For these purposes, the sealing roll 212 is driven. In the lower sealing chamber 225 of the zinc coating chamber 220 also, a nitrogen gas or nitrogen-hydrogen mixture gas is spouted through the gas spouting nozzle 225*a* so as to form a gas curtain, and to adjust the internal pressure of the zinc coating chamber 220. The coated steel sheet is heated by the reheating furnace 230 to make the imperfectly adhered zinc powders melt-adhere on the steel sheet. Further, if necessary, the coated steel sheet is subjected to a zinc-iron alloying reaction within a holding chamber. When cooling the reheated steel sheet, if a water cooling method is adopted, the cooling efficiency is improved. The steam which is generated during the water cooling is not fed into the zinc coating chamber but discharged to the outside by the help of the air curtain of the cooling device. Depending on cases, the coated steel sheet can be washed before it is contacted with the tension roll, thereby completely removing the loosely adhered zinc powders. The nitrogen or nitrogen-hydrogen mixture gas is heated by the gas heating device 270 before being supplied through the gas supply tube so as to be used in the zinc coating.

Now the method for coating zinc on the steel sheet according to the present invention will be described in detail.

In the present invention, a steel sheet which has been heated to a proper temperature is contacted with solid phase metallic zinc powders which are suspended.

Thus owing to the latent heat of the steel sheet, the zinc powders adhere on the surface of the steel sheet perfectly or imperfectly. Therefore, a coated layer is formed, and in the case where the adherence is imperfect, a reheating is carried out, so that a perfect adherence can be realized through a melt-adherence.

Specifically, in the present invention, the desirable conditions for forming a perfect coated layer are as follows.

1) Oxides should not exist on the surfaces of the steel sheet, so that the coated layer would closely adhere on the steel sheet.
2) The steel sheet has to have a latent heat enough to ensure a perfect melt-adherence of the zinc powders on the steel sheet.

In a state with Items 1 and 2 satisfied, if the following conditions are met, then a satisfactory quality in the zinc coated steel sheet can be obtained.

3) In order to obtain a uniform coated layer, the particles of the zinc powders should have less than a certain size.
4) The adherence of the coated layer should be superior, Item 1 has to be met, and an excessive formation of an alloy layer (Γ phase) on the boundary between the coated layer and the steel sheet should be inhibited.
5) In the zinc powder adhered layer, imperfect adherences can easily occur, and these imperfectly adhered powders should be removed or made to melt-adhere for ensuring the quality of the zinc coated sheet.

In the present invention, the conditions for meeting the above Items 1–5 are as follows.

If Item 1 is to be met, the atmosphere which is used during the heating of the steel sheet has to be a reducing gas or a non-oxidizing gas. In the steel manufacturing industry, this condition can be satisfied in the continuous annealing furnace which is used in manufacturing cold-rolled steel sheets. Generally, the used gases are mixtures of nitrogen plus hydrogen or nitrogen plus carbon monoxide. In the general continuous annealing furnace, the formation of oxides rarely occurs, and therefore, Item 1 can be sufficiently satisfied.

If Item 2 is to be met, the temperature of the steel sheet should be preferably limited to 420–730° C., and the reason is as follows. That is, at a temperature of 419° C. which is the melting point of zinc, there can occur imperfect adherences or adherences through diffusion reactions. However, if a sound coated layer is to be ensured, the reheating step is necessary.

At the reheating step, when the zinc powders melt-adhere, the external appearance of the steel sheet may be aggravated due to the volume contraction. Further, too much load is imposed on the reheating furnace. On the other hand, if the steel sheet is heated to above 730° C., the mechanical properties may be aggravated, and a zinc-iron alloying reaction is excessively promoted, with the result that the adherence of the coated layer is adversely affected.

If Item 3 is to be met, the average particle size of the zinc powders should be preferably limited to less than 45 $\mu$m (−325 mesh). In the case where the coated amount is as low as 50 g/m$^2$, if the average particle size is more than 45 $\mu$m, then the adhered powder amount is too small, with the result that some parts of the steel sheet may be exposed bare, thereby giving a non-uniform zinc coating.

As to Item 4, when the zinc powders adhere on the heated steel sheet, the iron atoms and the zinc atoms diffuse mutually to form an alloy layer. If this is to be prevented, it is known that the formation of Zn—Al compounds or the like on the boundary between the coated layer and the steel sheet is effective. If this is to be ensured, the aluminum content within the zinc powders should be preferably limited to 0.1–0.7 wt %.

If the Al content is less than 0.1%, an alloy layer is developed on the boundary, and therefore, the close adherence in the zinc coating is aggravated. On the other hand, if the Al content is more than 0.7%, although there is no problem in the formation of the coated layer, the formed coated layer is a Zn—Al alloy layer rather than a pure zinc layer. Therefore, the coated sheet is not suitable for use in automobiles and electronic apparatuses.

If Item 5 is to be met, the steel sheet should be subjected to a reheating after its passage through the zinc coating chamber. If this step is omitted, the imperfectly adhered zinc powders can be transferred to various rolls to cause defects such as dent or the like. As to the reheating conditions, the reheating is carried out at a temperature of 420–650° C. for 1–20 seconds.

More precise conditions are decided by the composition of the target coated layer. That is, if the target coated layer is a pure zinc layer, then the steel sheet may be heated to 420–500° C. Then the zinc powders are completely melt-adhered to form an acceptable zinc coated layer. When a Zn—Fe alloy coated layer is aimed at, the steel sheet is heated at 500~650° C. for 10~20 seconds so as to promote the alloying reactions. Thus the loosely adhered zinc powders are made to melt-adhere, as well as promoting the alloying reactions. In this way, the reheating is carried out suitably with the composition of the coated layer after the steel sheet has passed through the zinc coating chamber as described above. Therefore, the loosely adhered zinc powders are converted into a coated layer, and at the same time, a coated layer having the target Fe content can be obtained.

In the present invention, the interior of the zinc coating chamber has to be filled with an inert gas or a reducing gas, and has to be filled with fluidized zinc powders. The temperature of the zinc coating chamber should be preferably limited to below 250° C.

If the zinc powders are contacted to the steel sheet based on the general method such as spouting or the like, locally non-uniform portions will necessarily occur due to the differences in the flow pattern, thereby making it difficult to obtain a uniform coated layer. Therefore, the present inventors studied the method of contacting the zinc powders to the steel sheet, and as a result, found the following fact. That is, if fluidized zinc powders like a fog are uniformly dispersed within the zinc coating chamber, and if the steel sheet is made to pass through the fog, then a uniform coated layer could be obtained.

Figure 6:
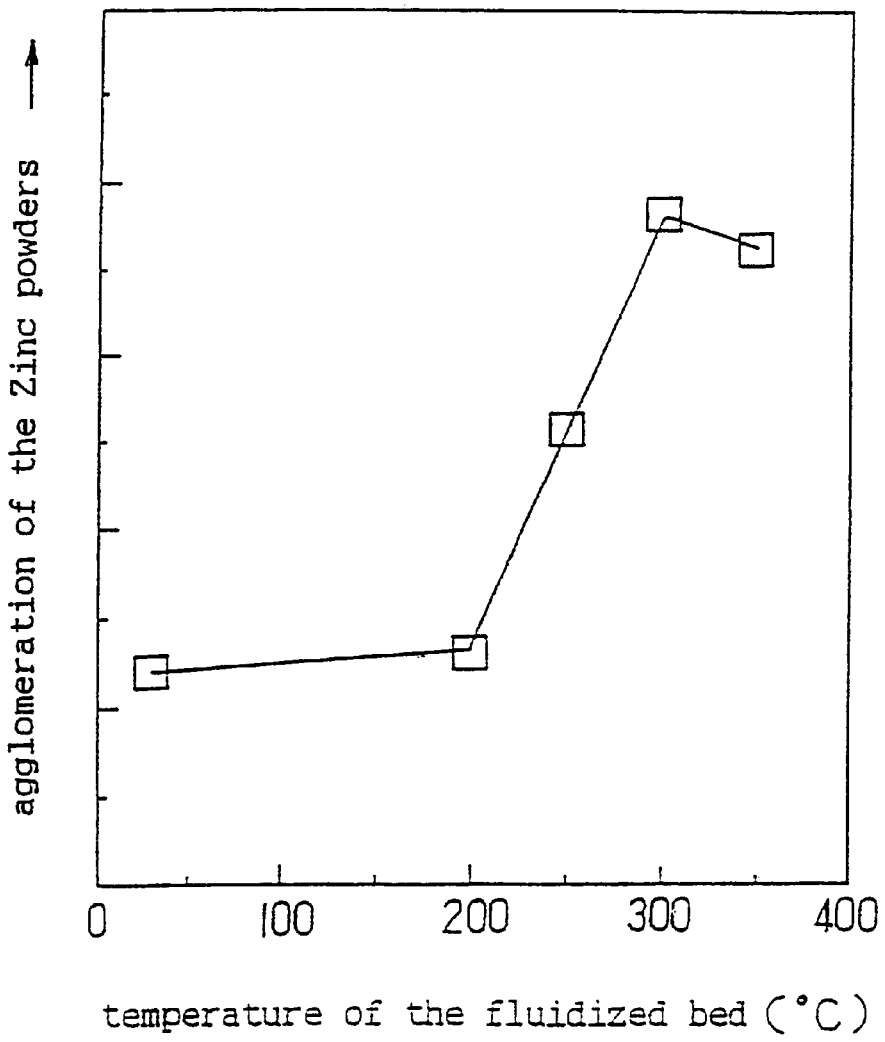
FIG. 6 is a graphical illustration showing the variation of agglomeration of the zinc powders versus the temperature of the fluidized bed within the zinc coating chamber.

Under this condition, the gas which is used for forming the fluidized bed of the zinc powders should be a reducing gas or a non-oxidizing gas. Otherwise, oxidation reactions occur on the surfaces of the steel sheet, and consequently, the adherence of the coated layer is aggravated. Further, if the temperature of the fluidized bed of the zinc powders exceeds 250° C., then the fluidized zinc powders are liable to be agglomerated as shown in FIG. 6, with the result that the stable fluidizing is destroyed. Consequently, the zinc particles adhere on the manufacturing facility in the form of agglomerates.

After satisfying the Items 1, 2, 3, 4 and 5, if the zinc coating method is to have an efficiency, the desired coated amount has to be obtained in an easy manner.

Figure 7:
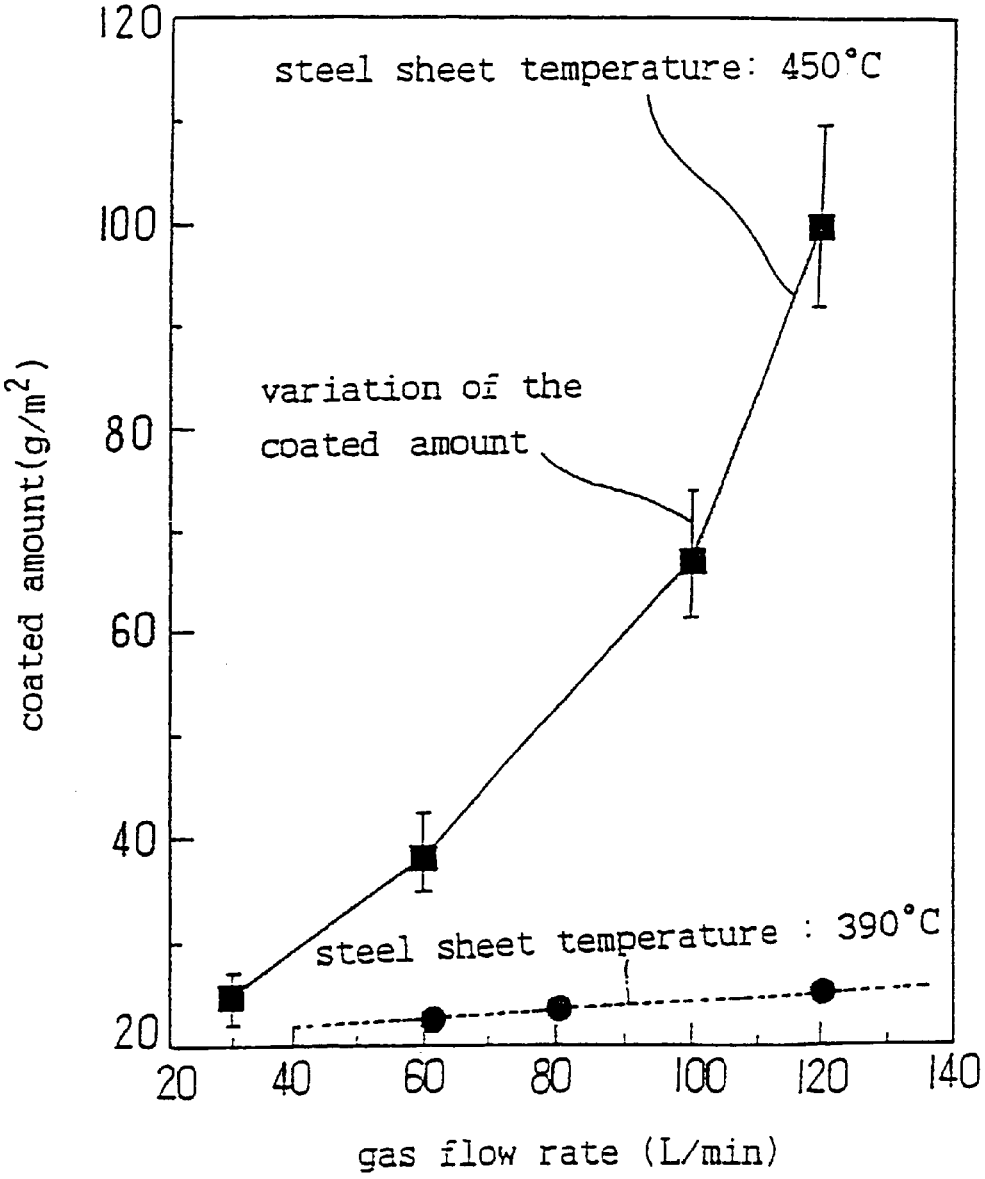
FIG. 7 is a graphical illustration showing the variation of the coated amount versus the variation of the gas flow rate.

In the present invention, if the above conditions are all met, it was confirmed as shown in FIG. 7 that the coated amount can be adjusted by adjusting the flow rate of the gas which is used for forming the fluidized zinc bed. FIG. 7 is a graphical illustration showing the variation of the coated amount versus the variation of the gas flow rate, when the temperatures of the coated steel sheets are different. This is an evidence to the fact that, if all the conditions of the present invention are satisfied, as the gas flow rate increases, the movements of the zinc powders become brisk, and the zinc particles collide with the steel sheet in an increased amount. That is, if the temperature of the steel sheet is below 420° C., the diffusion velocities become slow, and therefore, the coated speed becomes slow. Therefore, a coated amount of 100 g/m$^2$ or more within 5 seconds cannot be obtained unlike the general cases.

Therefore, in the present invention, the temperature of the steel sheet is limited in view of the general zinc coated amount and the limit of the treatment time of the manufacturing facility.

Now the method for coating zinc on the steel sheet by utilizing the electrostatic attraction according to the present invention will be described.

If the zinc coating is to be carried out according to the present invention, zinc powders have to be supplied through the powder supply device 246, and the zinc powders have to be fluidized within the fluidized bed forming chamber 240 by using a gas which is spouted from below.

The reason why the zinc powders have to be fluidized in advance is as follows.

The zinc powders have a naturally agglomerating trend, and therefore, if they are spouted as they are stored, then they are agglomerated into large particles so as to form coarse secondary particles. If such coarse secondary particles are spouted, the electrostatic attractions cannot give a satisfactory effect. Further, coating differences are generated over the different parts of the steel sheet, and therefore, a uniform coated layer can hardly be obtained.

Therefore, the present inventors studied on the method of carrying the zinc powders. As a result of the study, the present inventors found the following facts. That is, if the fluidized bed forming technique is employed, then particles of more than a certain size can be prevented from entering into the zinc coating chamber.

Therefore, in the present invention, the separate fluidized bed forming chamber 240 is provided separately from the zinc coating chamber 220. Then the zinc powders are carried from the fluidized bed forming chamber 240 to the zinc coating chamber 220.

The size of the particles suspended within the fluidized bed forming chamber 240 is closely related to the pressure of the gas which is spouted from below. As the pressure of the spouted gas increases, so the size of the suspended particles increases.

Therefore, if the pressure of the spouted gas is adjusted, then the coarse secondary particles can be made to sink onto the bottom, and the particles of the desired size can be suspended, so that they can be carried to the zinc coating chamber. Further, an injection pump 223*b* which is based on the principle of the venturi tube is installed on the zinc powder carrying path between the fluidized bed forming chamber 240 and the zinc coating chamber 220. Then the agglomerates receive mechanical impacts from an auxiliary gas so as to be disintegrated into individual particles. Therefore, the survival opportunity of the coarse secondary particles is further diminished, thereby giving a uniform distribution of the particles during the carriage of the zinc powders. Thus only fine primary zinc particles adhere on the steel sheet to be converted into a coated layer. Then the microstructure of the coated layer becomes more uniform, and the melting speed of the zinc powders becomes faster. Then the departure of the zinc particles becomes rarer, and therefore, the method becomes more advantageous for a thick zinc coating. The external appearance of the coated steel sheet is also improved by the uniform suspension of the zinc powders within the gas. Further, the electrostatic effect on the particles becomes greater, and therefore, the influence of the spouting track decreases, with the result that a more uniform coated layer can be obtained.

As described above, the zinc powders which have been fluidized in the fluidized bed forming chamber 240 are spouted into the zinc coating chamber 220 through the powder spouting device 223. Thus the zinc powders maintain a suspended slate within the zinc coating chamber 220, and the zinc powders are electrostatically charged.

For this purpose, the temperature of the steel sheet is maintained above the melting point of zinc, and the zinc coating power is the force of the carrying gas and the electrostatic attractions.

Owing to a temperature difference between the zinc powders and the steel sheet, a convection boundary layer is formed on the surfaces of the steel sheet, and the mentioned layer obstructs the access of the zinc powders. Therefore, in a method in which the powders are spouted in a simple manner, the pressure of the carrier gas has to be increased, so that the powders can overcome the boundary layer to adhere on the steel sheet. In this case, differences in the spouting tracks occur over different parts of the steel sheet, and consequently, the coated layer becomes non-uniform. However, the electrostatic attraction is proportional to the square of the distance between two charged objects ($F \propto 1/r^2$). Therefore, the electrostatic attractive force is large near the convection boundary layer of the steel sheet, and therefore, the zinc powders which are carried to the convection boundary layer by the carrier gas easily adhere on the steel sheet. If this electrostatic attraction is utilized, the zinc powders adhere on the steel sheet even if the pressure of the carrier gas is lowered to as low as not to affect the steel sheet, and the spouting tracks do not appear on the surface of the steel sheet. The zinc powders which sequentially adhere on the steel sheet melt-adhere on the steel sheet in a sequential manner before the powder lose the electrostatic charges. Thus the zinc powders are firmly melt-attached on the steel sheet, and therefore, detachments of the zinc particles due to the dissipation of the electrostatic charges do not occur. Therefore, the method of the present invention is advantageous for a thick zinc coating.

In the present invention, the zinc powders are fluidized, and the zinc powders are electrostatically charged as described above. Therefore, the zinc coating can be done more speedily compared with the conventional method.

Then the steel sheet is heated to 420~730° C. and grounded. This steel sheet is made to pass through the electrostatically charged fluidized zinc powders, so that the zinc powders would be melt-attached so as to form a coated layer.

Meanwhile, the residual uncoated zinc powders which remain on the bottom are sent to the cyclone. In the cyclone, the zinc powders are separated from the gas, and the gas is discharged, while the separated zinc powders are sent to the powder supply device 246, thereby recovering the zinc powders.

In the present invention, the zinc powders should be preferably limited to an average size of 45 $\mu$m. The average size of 45 $\mu$m cannot be applied to a small coated-amount zinc coating, because in this case some parts of the steel sheet may be exposed.

Further, when the zinc powders melt-adhere, iron and zinc atoms mutually diffuse to form an alloy layer, nd therefore, this phenomenon needs to be inhibited. Thus Fe—Al or Fe—Al—Zn compounds may be formed on the boundary between the coated layer and the steel sheet.

The influence of an aluminum content on the zinc powders was studied, and the result showed the following fact.

That is, the Al content should be preferably limited to 0.1–0.7 wt %. There is no problem in forming the coated layer, even if the Al content is more than 0.7%.

However, in this case, the coated layer is not a zinc coated layer, but an Al—Zn alloy coated layer.

In a zinc coating, the zinc particles adhered on the steel sheet are transferred to various rolls to cause defects such as dent. If the coated steel sheet is reheated, then the defects such as dent can be avoided.

According to experiments, if the reheating conditions are precisely adjusted, then the composition of the coated layer can be varied. That is, in the case where a pure zinc coating is aimed at, the steel sheet is heated at 420–500° C. for 1–5 seconds, and then, is cooled. Then only the zinc powders can be coated without inviting the alloying reactions. On the other hand, in the case where a Zn—Fe alloy coated layer is the target, the coated steel sheet is heated at 500–650° C. for 10 to 20 seconds so as to promote the alloying reactions.

The heating period of the pure zinc coating is shorter than that of an alloy zinc coating, and therefore, the attachment of the zinc particles on the rolls becomes more probable. However, if a wash is carried out before the steel sheet contact with the rolls, then the loosely attached zinc powders can be completely removed. Therefore, the conventional problems such as the attachment of the zinc particles on the deflector roll or the peeling of the coated layer can be completely solved.

In the present invention, the internal atmosphere of the zinc coating chamber consists of an inert gas or a reducing gas, while internal temperature of the zinc coating chamber is the normal temperature to 250° C. The reason is as follows. That is, if the temperature of the steel sheet during the zinc coating drops to below the melting point of zinc, then the adhering efficiency of the zinc powders decreases. In order to prevent this, the atmospheric gas should have a temperature as high as possible. However, if the temperature of the atmospheric gas exceeds 250° C., the fluidized zinc particles tend to be agglomerated as shown in FIG. 6, thereby aggravating the stability of the fluidized bed. The optimum temperature of the atmospheric gas is 100–200° C.

Under the above conditions, the flow rate of the gas and the applied voltage of the electrodes are adjusted to adjust the coated amount.

FIG. 7 is a graphical illustration showing the variation of the coated amount versus the variation of the gas flow rate, when the fluidized zinc powders are injected into the zinc coating chamber. This drawing shows that as the gas flow rate increases, the adhered zinc amount increases, if the conditions of the present invention are satisfied.

Figure 8:
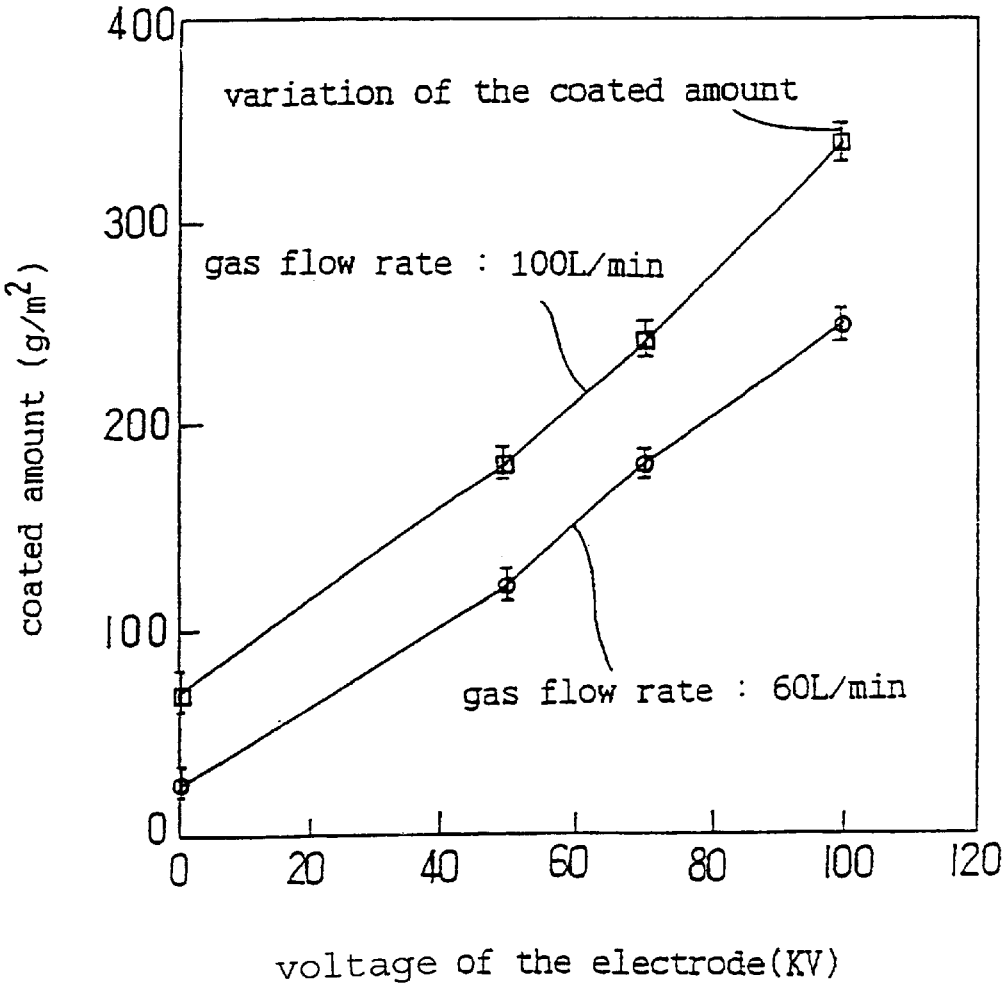
FIG. 8 is a graphical illustration showing the variation of the coated amount versus the variation of the voltage of the electrode.

FIG. 8 is a graphical illustration showing the variation of the coated amount versus the variation of the voltage of the electrode, in a state with the steel sheet grounded. As the applied voltage of the electrode increases, the zinc coated amount steeply increases, to such a degree that a coated amount of 200 g/m$^2$ can be easily obtained. Under this condition, in electrostatically charging the zinc powders, the corona charging or the induction charging is employed. For this purpose, a sharp tipped nozzle and a net type electrode are used. As the applied voltage of the electrode, −100 KV or 1~100 KV will be enough.

When the zinc powders are used as in the case of the present invention, the zinc powders can be introduced into the annealing furnace. Consequently, the zinc powders can adhere on various rolls to cause defects such as dent. Further, if the zinc powders are leaked to the outside of the manufacturing facility, the powders may hurt the health of workers. Therefore, the recovery of the zinc powders is very important. In this context, the internal pressure of the zinc coating chamber should be properly adjusted, and the leakage of the zinc powders should be prevented. That is, measures for these should be prepared. Accordingly in the present invention, the sealing chambers are provided above and below the zinc coating chamber, and the zinc powder recovering device is installed.

Now the present invention will be described based on actual examples.

EXAMPLE 1

A cold rolled steel strip was heated to the temperatures of Tables 1 and 2. Then it was passed through a fluidized bed of zinc powders to coat it up to the optimum coated amount. Then the coated steel strip was reheated, thereby preparing coated test pieces. In varying the coated amount, the relationship between the coated amount and the gas flow rate as shown in FIG. 6 was utilized.

Tables 3 and 4 show the effects of the zinc coating 30 conditions.

The adherence strength of the coated layer was evaluated based on a 45-degree bending test, i.e. based on the peeling degree during the bending test. The level of the absolutely non-peeling of the coated layer was shown by "◎". The level in which the traces of peeling appeared was shown by "O". The level in which the traces of peeling definitely appeared was shown by "Δ". The level in which the coated layer was almost peeled off was shown by "X".

As to the coating uniformness, the external appearance was observed by human eyes, and the structure of the coated layer was observed by magnifying it to 2000 times by a scanning microscope. Thus, if it has a uniform structure without any pin hole, then it was assigned with "◎". If the external appearance was uniform, but if the structure was not uniform, then it was assigned with "0". If both the external appearance and the structure were not uniform, it was assigned with "Δ". If a coated layer was not formed at all, then it was assigned with "X".

The coatability indicates the maximum coated amount which can be obtained within 5 seconds as allowed in the general continuous annealing factory. "X" indicates the case where a coated layer was not formed at all. "Δ" indicates the case where a thin coated layer of less than 40 g/m$^2$ was obtained. "O" indicates the case where the desired coated amount was obtained by varying the zinc coating conditions.

The paintability was evaluated in such a manner that a melamine alkydic pigment was spread, and then, straight scratchings were carried out at intervals of 1 mm in the form of check works. Then the evaluation was carried out.

TABLE 1

| | | Coated layer forming conditions | | | | | | |
|---|---|---|---|---|---|---|---|---|
| | | Sheet temperature (° C.) | Size of Zn powder (μm) | Al content within Zn powder (wt. %) | Atmosphere | Temperature of fluidized bed | Heating time (sec) | Reheating temperature (° C.) |
| Comparative example | 1 | 740 | 5 | <0.01 | $N_2$ | 200 | non-reheating | |
| | 2 | 740 | 5 | 0.18 | $N_2 + H_2$ | 200 | non-reheating | |
| | 3 | 500 | 5 | 0.18 | $N_2 + H_2$ | 100 | 1 | 410 |
| | 3 | 500 | 5 | <0.01 | $N_2$ | 100 | 5 | 410 |
| | 5 | 420 | 40 | <0.01 | $N_2$ | 100 | 25 | 410 |
| | 6 | 500 | 40 | 0.18 | $N_2$ | 100 | 25 | 650 |
| | 7 | 500 | 0.5 | 0.14 | $N_2$ | 100 | 25 | 410 |
| | 8 | 390 | 20 | 0.18 | $N_2$ | 100 | 5 | 520 |
| | 9 | 390 | 5 | 0.18 | $N_2$ | 100 | 10 | 520 |
| | 10 | 740 | 5 | 0.18 | $N_2$ | 150 | 5 | 520 |

TABLE 1-continued

| | | Coated layer forming conditions | | | | | | |
|---|---|---|---|---|---|---|---|---|
| | | Sheet temperature (° C.) | Size of Zn powder (μm) | Al content within Zn powder (wt. %) | Atmosphere | Temperature of fluidized bed | Heating time (sec) | Reheating temperature (° C.) |
| | 11 | 740 | 5 | 0.18 | $N_2$ | 100 | 10 | 520 |
| | 12 | 450 | 5 | <0.01 | $N_2$ | 100 | 5 | 520 |
| | 13 | 600 | 20 | 0.18 | $N_2$ | 100 | 5 | 660 |
| | 14 | 450 | 20 | 0.18 | $N_2 + H_2$ | 200 | 25 | 420 |
| | 15 | 500 | 50 | 0.14 | $N_2 + H_2$ | 200 | 15 | 550 |
| | 16 | 550 | 50 | 0.18 | $N_2 + H_2$ | 200 | 15 | 520 |
| | 17 | 730 | 70 | 0.18 | $N_2 + H_2$ | 200 | 2 | 650 |
| | 18 | 500 | 20 | <0.01 | $N_2 + H_2$ | 200 | 15 | 520 |
| | 19 | 500 | 5 | <0.01 | $N_2 + H_2$ | 200 | 12 | 520 |
| | 20 | 500 | 5 | 0.18 | oxidizing | 200 | 15 | 520 |
| | 21 | 730 | 5 | 0.18 | oxidizing | 200 | 8 | 650 |
| | 22 | 730 | 5 | 0.18 | $N_2 + H_2$ | 300 | 8 | 650 |
| | 23 | 550 | 5 | 0.14 | $N_2 + H_2$ | 300 | 15 | 600 |

TABLE 2

| | | Coated layer forming conditions | | | | | | |
|---|---|---|---|---|---|---|---|---|
| | | Sheet temperature (° C.) | Size of Zn powder (μm) | Al content within Zn powder (wt. %) | Atmosphere | Temperature of fluidized bed | Heating time (sec) | Reheating temperature (° C.) |
| Inventive example | 1 | 500 | 5 | 0.18 | $N_2 + H_2$ | 100 | 1 | 420 |
| | 2 | 500 | 5 | 0.1 | $N_2$ | 100 | 5 | 420 |
| | 3 | 420 | 40 | 0.1 | $N_2$ | 100 | 20 | 420 |
| | 4 | 500 | 40 | 0.18 | $N_2$ | 100 | 20 | 650 |
| | 5 | 500 | 0.5 | 0.14 | $N_2$ | 100 | 20 | 420 |
| | 6 | 420 | 20 | 0.18 | $N_2$ | 100 | 5 | 520 |
| | 7 | 420 | 5 | 0.18 | $N_2$ | 100 | 10 | 520 |
| | 8 | 730 | 5 | 0.18 | $N_2$ | 150 | 5 | 520 |
| | 9 | 730 | 5 | 0.18 | $N_2$ | 100 | 10 | 520 |
| | 10 | 450 | 5 | 0.1 | $N_2$ | 100 | 5 | 520 |
| | 11 | 450 | 20 | 0.18 | $N_2$ | 100 | 5 | 420 |
| | 12 | 600 | 20 | 0.18 | $N_2$ | 100 | 5 | 650 |
| | 13 | 450 | 20 | 0.18 | $N_2$ | 200 | 5 | 420 |
| | 14 | 450 | 20 | 0.18 | $N_2$ | 200 | 5 | 600 |
| | 15 | 450 | 20 | 0.18 | $N_2 + H_2$ | 200 | 20 | 420 |
| | 16 | 500 | 0.5 | 0.14 | $N_2 + H_2$ | 200 | 15 | 520 |
| | 17 | 500 | 45 | 0.14 | $N_2 + H_2$ | 200 | 15 | 550 |
| | 18 | 730 | 45 | 0.18 | $N_2 + H_2$ | 200 | 2 | 650 |
| | 19 | 500 | 20 | 0.1 | $N_2 + H_2$ | 200 | 15 | 520 |
| | 20 | 730 | 5 | 0.7 | $N_2 + H_2$ | 200 | 15 | 650 |
| | 21 | 450 | 5 | 0.7 | $N_2 + H_2$ | 200 | 20 | 500 |

TABLE 3

| | | Adherence of coated layer | Uniformness of coated layer | Coatability | Paintability |
|---|---|---|---|---|---|
| Comparative example | 1 | Δ | ○ | ○ | Δ |
| | 2 | Δ | ○ | ○ | Δ |
| | 3 | Δ | ○ | ○ | Δ |
| | 4 | Δ | ○ | ○ | Δ |
| | 5 | X | ○ | ○ | Δ |
| | 6 | Δ | ○ | ○ | ○ |

TABLE 3-continued

| | Adherence of coated layer | Uniformness of coated layer | Coatability | Paintability |
|---|---|---|---|---|
| 7 | Δ | ○ | ○ | ○ |
| 8 | ○ | ○ | Δ | ○ |
| 9 | ○ | ○ | Δ | ○ |
| 10 | Δ | Δ | ○ | ○ |
| 11 | Δ | Δ | ○ | ○ |
| 12 | Δ | ○ | ○ | ○ |
| 13 | Δ | ○ | Δ | ○ |
| 14 | Δ | ○ | ○ | ○ |
| 15 | ◎ | X | ○ | ○ |
| 16 | ◎ | X | ○ | ○ |
| 17 | ◎ | X | ○ | ○ |
| 18 | X | ○ | ○ | ○ |
| 19 | X | ○ | ○ | ○ |
| 20 | X | X | X | X |
| 21 | X | X | X | X |
| 22 | ○ | ○ | ◎ | ○ |
| 23 | ○ | ○ | ◎ | ○ |

◎: Excellent, ○: Adequate, Δ: Bad, X: Very bad

TABLE 4

| | | Adherence of coated layer | Uniformness of coated layer | Coatability | Paintability |
|---|---|---|---|---|---|
| Inventive example | 1 | ◎ | ○ | ○ | ◎ |
| | 2 | ◎ | ○ | ○ | ◎ |
| | 3 | ◎ | ○ | ○ | ◎ |
| | 4 | ◎ | ○ | ○ | ◎ |
| | 5 | ◎ | ○ | ○ | ◎ |
| | 6 | ◎ | ○ | ○ | ◎ |
| | 7 | ◎ | ○ | ○ | ◎ |
| | 8 | ◎ | ○ | ○ | ◎ |
| | 9 | ◎ | ○ | ○ | ◎ |
| | 10 | ◎ | ○ | ○ | ◎ |
| | 11 | ◎ | ○ | ○ | ◎ |
| | 12 | ◎ | ○ | ○ | ◎ |
| | 13 | ◎ | ○ | ○ | ◎ |
| | 14 | ◎ | ○ | ○ | ◎ |
| | 15 | ◎ | ○ | ○ | ◎ |
| | 16 | ◎ | ○ | ○ | ◎ |
| | 17 | ◎ | ○ | ○ | ◎ |
| | 18 | ◎ | ○ | ○ | ◎ |
| | 19 | ◎ | ○ | ○ | ◎ |
| | 20 | ◎ | ◎ | ○ | ◎ |
| | 21 | ◎ | ◎ | ○ | ◎ |

◎: Excellent, ○: Adequate, Δ: Bad, X: Very bad

Table 3 shows the results of evaluations of the qualities of the coated layer for Comparative examples 1–23 which were manufactured at the conditions of Table 1. As shown in Table 3, at least one among the adherence of the coated layer, the uniformness of the coated layer, the coatability and the paintability was defective. This is due to the fact that at least one item among them departed from the range of the present invention. On the other hand, the coated layers which were manufactured based on the method of the present invention as shown in Table 2 were all satisfactory as shown in Table 4 in all the respects including the adherence of the coated layer, the uniformness of the coated layer, the coatability and the paintability.

EXAMPLE 2

A zinc coating was carried out at conditions the same as those of the inventive example 1 of Table 2, except that the sheet temperature and the gas flow rate were varied as shown in FIG. 6. The variation of the coated amount versus the variation of the gas flow rate for the fluidized bed was checked, and the results are shown in FIG. 6.

As shown in FIG. 6, if the method of the present invention is applied, the coated amount increases as the gas flow rate increases.

EXAMPLE 3

A zinc coating was carried out by using the zinc coating apparatus of FIG. 4 at the conditions of Tables 5 and 6. Then the adherence of the coated layer, the uniformness of the coated layer, the coatability and the paintability were evaluated, and the results are shown in Tables 7 and 8 below.

In tables 5 and 6, the comparative examples and the inventive examples 22–29 used an electrode voltage of −55 KV, while the inventive examples 30–31 used an electrode voltage of −90 KV.

Meanwhile, the flow rate of the fluidized bed forming gas was 100 L/min, while the flow rate of the auxiliary gas at the injection pump was 100 L/min.

TABLE 5

| | | Coated layer forming conditions | | | | | | |
|---|---|---|---|---|---|---|---|---|
| | | Sheet temperature (° C.) | Size of Zn powder (μm) | Al content within Zn powder (wt. %) | Atmosphere | Temperature of fluidized bed | Heating time (sec) | Reheating temperature (° C.) |
| Comparative example | 24 | 740 | 5 | 0.18 | $N_2$ | 100 | non-reheating | |
| | 25 | 410 | 5 | 0.18 | $N_2$ | 100 | 25 | 550 |
| | 26 | 550 | 50 | 0.18 | $N_2$ | 150 | 1 | 550 |
| | 27 | 550 | 15 | 0.07 | $N_2$ | 200 | non-reheating | |
| | 28 | 720 | 15 | 0.8 | $N_2$ | 100 | 5 | 550 |
| | 29 | 600 | 15 | 0.14 | oxidizing | 100 | 10 | 550 |
| | 30 | 600 | 5 | 0.5 | $N_2$ | 250 | 5 | 600 |
| | 31 | 550 | 5 | 0.3 | $N_2$ | 100 | 25 | 650 |

TABLE 6

| | | Coated layer forming conditions | | | | | | |
|---|---|---|---|---|---|---|---|---|
| | | Sheet temperature (° C.) | Size of Zn powder (μm) | Al content within Zn powder (wt. %) | Atmosphere | Temperature of fluidized bed | Heating time (sec) | Reheating temperature (° C.) |
| Inventive example | 22 | 550 | 5 | 0.18 | $N_2$ | 120 | 5 | 550 |
| | 23 | 720 | 5 | 0.18 | $N_2$ | 100 | non-reheating | |
| | 24 | 420 | 5 | 0.18 | $N_2$ | 100 | non-reheating | |
| | 25 | 550 | 15 | 0.18 | $N_2$ | 150 | 10 | 550 |
| | 26 | 550 | 15 | 0.1 | $N_2$ | 200 | 1 | 650 |
| | 27 | 550 | 15 | 0.7 | $N_2$ | 100 | 5 | 550 |
| | 28 | 600 | 45 | 0.14 | $N_2$ | 100 | 10 | 550 |
| | 29 | 600 | 5 | 0.5 | $N_2$ | 200 | 5 | 600 |
| | 30 | 550 | 5 | 0.3 | $N_2$ | 100 | 20 | 650 |
| | 31 | 550 | 5 | 0.2 | $N_2$ | 100 | non-reheating | |

TABLE 7

| | | Adherence of coated layer | Uniformness of coated layer | Coated amount ($g/m^2$) | Paintability |
|---|---|---|---|---|---|
| Comparative Example | 24 | Δ | ○ | 200 | ◎ |
| | 25 | ○ | Δ | 80 | ○ |
| | 26 | ○ | Δ | 220 | Δ |
| | 27 | X | ○ | 200 | ○ |
| | 28 | ○ | ○ | 200 | X |
| | 29 | X | X | — | X |
| | 30 | ○ | Δ | 200 | ○ |
| | 31 | Δ | ○ | 200 | Δ |

TABLE 8

| | | Adherence of coated layer | Uniformness of coated layer | Coated amount ($g/m^2$) | Paintability |
|---|---|---|---|---|---|
| Inventive Example | 22 | ◎ | ◎ | 200 | ◎ |
| | 23 | ◎ | ○ | 200 | ◎ |
| | 24 | ◎ | ○ | 220 | ◎ |
| | 25 | ◎ | ◎ | 200 | ◎ |
| | 26 | ◎ | ◎ | 200 | ◎ |

TABLE 8-continued

| | Adherence of coated layer | Uniformness of coated layer | Coated amount ($g/m^2$) | Paintability |
|---|---|---|---|---|
| 27 | ◎ | ◎ | 200 | ◎ |
| 28 | ◎ | ○ | 200 | ◎ |
| 29 | ◎ | ◎ | 200 | ◎ |
| 30 | ◎ | ◎ | 300 | ◎ |
| 31 | ◎ | ○ | 300 | ◎ |

As shown in Table 7 above, the coated amount is about 200 $g/m^2$ in all of them, except the comparative example 25 which shows a low coated amount.

The comparative example 25 shows a coated amount as low as 80 $g/m^2$, and this is due to the fact that the adhered zinc powders are detached before they are converted into a coated layer.

Meanwhile, the comparative examples 24–31 show one or more defects among the adherence of the coated layer, the uniformness of the coated layer, and the paintability. This is due to the fact that they departed from at least one or more of the coated layer forming conditions of the present invention.

On the other hand, as shown in Table 8, the inventive examples achieved the coated layers of more than 200 $g/m^2$ in all of them. Particularly, in the inventive examples 30 and 31 in. which a voltage of −90 KV was applied, a coated amount of 300 $g/m^2$ was obtained.

In the cases of the inventive examples 22, 23 and 31 in which the reheating was not carried out, some individual zinc particles were observed, but the adherence of the coated layer and the paintability were all satisfactory.

In the cases of the other inventive examples, the adherence of the coated layer, the uniformness of the coated layer, and the paintability were all satisfactory.

EXAMPLE 4

A zinc coating was carried out at conditions the same as those of the inventive example 22 of Table 6, except that the gas flow rate and the electrode voltage were varied as shown in FIG. 8. The evaluated results are shown in FIG. 8.

As shown in FIG. 8, in the present invention, a coated amount of 200 $g/m^2$ or more could be easily obtained.

According to the present invention as described above, a zinc coating apparatus and a method therefor are provided in which the zinc coating speed is as fast as to be connected to a continuous annealing furnace for cold rolled steel sheet, the coating deviations are smaller than those of the hot dip galvanizing apparatus, and a thick coated layer can be easily formed. Therefore, compared with the conventional method, the present invention improves the product quality and productivity.

What is claimed is:

1. An apparatus for continuously coating zinc on a steel sheet, comprising:

a fluidized bed forming chamber for forming a fluidized bed of zinc powders by suspending the zinc powders in a gas;

a zinc coating chamber which receives the fluidized bed of zinc powders through a powder inlet tube from said fluidized bed forming chamber, wherein a steel sheet heated by a heating means is passed through the fluidized bed of the zinc powders, and wherein the zinc powders melt-adhere on the steel sheet during a passing of the steel sheet through the fluidized bed of zinc powders;

a cyclone for separating the zinc powders from the gas after recovery of the zinc powders from said zinc coating chamber, to discharge the gas, and to return the separated zinc powders to said fluidized bed forming chamber, wherein said cyclone is in connection with both said zinc coating chamber and said fluidized bed forming chamber;

a deflector roll for shifting an advancing direction of the steel sheet after its admittance into said zinc coating chamber, wherein said deflector roll is located upstream from said zinc coating chamber;

a tension roll for shifting an advancing direction of a zinc coated steel sheet, wherein said tension roll is located downstream from said zinc coating chamber;

said zinc coating chamber comprising: said powder inlet tube connected from a side wall of said zinc coating chamber to said fluidized bed forming chamber to inject the fluidized zinc powders into said zinc coating chamber; a gas inlet tube for forming a turbulent flow of the zinc powders and for preventing a leakage of the zinc powders; and a recovering tube for recovering uncoated zinc powders;

said gas inlet tube being disposed above said powder inlet tube, and said recovering tube being disposed below said powder inlet tube;

said recovering tube being connected between said zinc coating chamber and said cyclone, and a suction pump being connected to said cyclone;

a separating plate provided within said zinc coating chamber, for making uncoated zinc powders flow to said recovering tube, and for preventing the zinc powders from flowing to a stabilizing roll; and a stabilizing roll disposed below said separating plate.

2. The apparatus as claimed in claim 1, wherein said heating means is an annealing furnace.

3. The apparatus as claimed in claim 1, wherein a reheating furnace is installed between said zinc coating chamber and said tension roll.

4. The apparatus as claimed in claim 2, wherein a reheating furnace is installed between said zinc coating chamber and said tension roll.

5. An apparatus for continuously coating zinc on a steel sheet, comprising:

a fluidized bed forming chamber for forming a fluidized bed of zinc powders by suspending the zinc powders in a gas;

a zinc coating chamber for receiving the fluidized zinc powders from said fluidized bed forming chamber through a powder spouting means, and causing the fluidized zinc powders to melt-adhere on a heated steel sheet:

a cyclone for separating the zinc powders from the gas after recovery of the zinc powders from said zinc coating chamber, to discharge the gas, and to return the separated zinc powders to said fluidized bed forming chamber, wherein said cyclone is in connection with both said zinc coating chamber and said fluidized bed forming chamber;

a deflector roll for shifting an advancing direction of the steel sheet after its admittance into said zinc coating chamber, wherein said deflector is located upstream from said zinc coating chamber;

a tension roll for shifting an advancing direction of a zinc coated steel sheets wherein said tension roll is located downstream from said zinc coating chamber;

said zinc coating chamber comprising a powder spouting means connected from a side wall of said zinc coating chamber to the fluidized bed forming chamber to spout the fluidized zinc powders into said zinc coating chamber;

said zinc coating chamber further comprising a recovering tube connected to said cyclone, for recovering uncoated zinc powders; and one or more electrodes provided in said zinc coating chamber, for electrostatically charging the zinc powders, said electrodes being connected to a voltage generating device.

6. The apparatus as claimed in claim 5, wherein a reheating furnace is installed between said zinc coating chamber and said tension roll.

7. The apparatus as claimed in claim 5, wherein said powder spouting device comprises: a powder carrying tube connected to said fluidized bed forming chamber; an injection pump connected to said powder carrying tube; and a powder spouting nozzle for spouting the zinc powders from said injection pump into said zinc coating chamber.

8. The apparatus as claimed in claim 5, wherein said one or more electrodes consist of a pair of sharp electrodes installed in the side walls of said zinc coating chamber, and a pair of net-shaped electrodes installed in said zinc coating chamber in a state insulated from said zinc coating chamber.

9. The apparatus as claimed in claim 7, wherein said one or more electrodes consist of a pair of sharp electrodes installed in the side walls of said zinc coating chamber, and a pair of net-shaped electrodes installed in said zinc coating chamber in a state insulated from said zinc coating chamber.

10. The apparatus as claimed in claim 5, wherein a cooling device is installed beneath said zinc coating chamber.

11. The apparatus as claimed in claim 10, wherein said cooling device comprises: a water spouting nozzle; and an air spouting nozzle for forming an air curtain above said water spouting nozzle.

12. The apparatus as claimed in claim 6, wherein said cooling device is disposed below said reheating furnace.

13. The apparatus as claimed in claim 12, wherein said cooling device comprises: a water spouting nozzle; and an air spouting nozzle for forming an air curtain above said water spouting nozzle.

14. The apparatus as claimed in claim 11, wherein a wash device is installed beneath said water spouting nozzle, for washing surfaces of the steel sheet.

15. The apparatus as claimed in claim 6, wherein said powder spouting device comprises: a powder carrying tube connected to said fluidized bed forming chamber; an injection pump connected to said powder carrying tube; and a powder spouting nozzle for spouting the zinc powders from said injection pump into said zinc coating chamber.

16. The apparatus as claimed in claim 15, wherein said one or more electrodes consist of a pair of sharp electrodes installed in the side walls of said zinc coating chamber, and a pair of net-shaped electrodes installed in said zinc coating chamber in a state insulated from said zinc coating chamber.

17. The apparatus as claimed in claim 13, wherein a wash device is installed beneath said water spouting nozzle, for washing surfaces of the steel sheet.

18. A method for continuously coating zinc on a steel sheet by making the steel sheet pass through a zinc coating chamber, comprising the steps of:

fluidizing zinc powders within a fluidized bed forming chamber by introducing a gas into said fluidized bed forming chamber;

supplying the fluidized zinc powders from said fluidized bed forming chamber to said zinc coating chamber by means of a powder inlet tube, and injecting an inert gas or a reducing gas into said zinc coating chamber through a side wall of said zinc coating chamber to form a fluidized bed within said zinc coating chamber;

passing a steel sheet heated to a temperature of 420°–730° C. through the fluidized bed within said zinc coating chamber to melt-attach the zinc powders on the steel sheet so as to form a coating layer;

reheating the zinc powder-adhered steel sheet at a temperature of 420°–650° C. for 1–20 seconds to make imperfectly adhered zinc powders melt-adhere on the surface of the steel sheet so as to form a coating layer; and discharging residual uncoated zinc powders from a bottom portion of said zinc coating chamber together with a gas by a cyclone, to separate the zinc powders from the gas so as to discharge the gas and so as to return the separated zinc powders to said fluidized bed forming chamber.

19. The method as claimed in claim 18, wherein the zinc powders have an average particle size of 45 $\mu$m.

20. The method as claimed in claim 18, wherein the zinc powders contain Al in an amount of 0.1–0.7 wt %.

21. The method as claimed in claim 18, wherein the reheating temperature is 420°–500° C. and the reheating time period is 1–5 seconds.

22. The method as claimed in claim 20, wherein the reheating temperature is 420°–500° C. and the reheating time period is 1–5 seconds.

23. The method as claimed in claim 18, wherein the reheating temperature is 500°–650° C. and the reheating time period is 10–20 seconds.

24. The method as claimed in claim 20, wherein the reheating temperature is 500°–650° C. and the reheating time period is 10–20 seconds.

25. The method as claimed in claim 18, wherein said zinc coating chamber has an atmospheric gas temperature of 250° C. or below.

26. The method as claimed in claim 20, wherein said zinc coating chamber has an atmospheric gas temperature of 250° C. or below.

27. The method as claimed in claim 19, wherein the zinc powders contain Al in an amount of 0.1–0.7 wt %.

28. The method as claimed in claim 19, wherein the reheating temperature is 420°–500° C. and the reheating time period is 1–5 seconds.

29. The method as claimed in claim 19, wherein the reheating temperature is 500°–650° C. and the reheating time period is 10–20 seconds.

30. The method as claimed in claim 15, wherein said zinc coating chamber has an atmospheric gas temperature of a temperature to 250° C.

31. A method for continuously coating zinc on a steel sheet by making the steel sheet pass through a zinc coating chamber, comprising the steps of:

receiving zinc powders from a powder supply device, and fluidizing the zinc powders within a fluidized bed forming chamber by introducing a gas into the fluidized bed forming chamber;

providing the fluidized zinc powders from said fluidized bed forming chamber to a zinc coating chamber by means of a powder spouting device to form a fluidized bed within said zinc coating chamber;

charging the zinc powders of the fluidized bed positively or negatively;

heating a steel sheet to 420°–730° C. and grounding the steel sheet, and making the steel sheet pass through the fluidized bed to make the charged zinc powders melt-adhere on the steel sheet;

sending residual zinc powders of a bottom portion of said zinc coating chamber to a cyclone together with a gas to separate the zinc powders from the gas, so as to discharge the gas, and so as to return the separated zinc powders to the powder supply device.

32. The method as claimed in claim 31, wherein the zinc powders have an average particle size of 45 $\mu$m.

33. The method as claimed in claim 31, wherein the zinc powders contain Al in an amount of 0.1–0.7 wt %.

34. The method as claimed in claim 31, wherein after zinc-coating the steel sheet, the steel sheet is reheated at a temperature of 420–650° C., for making loosely attached uncoated zinc powders melt-adhere on the steel sheet.

35. The method as claimed in claim 34, wherein the reheating temperature is 420°–500° C. and the reheating time period is 1–5 seconds.

36. The method as claimed in claim 34, wherein the reheating temperature is 500°–650° C. and the reheating time period is 10–20 seconds.

37. The method as claimed in claim 31, wherein the steel sheet is grounded, and said electrode is supplied with a voltage of −1~−100 KV, or 1~100 KV.

38. The method as claimed in claims 33, wherein the steel sheet is grounded, and said electrode is supplied with a voltage of −1~100 KV, or 1~−100 KV.

39. The method as claimed in claim 34, wherein the steel sheet is grounded, and said electrode is supplied with a voltage of −1~−100 KV, or 1~100 KV.

40. The method as claimed in claim 31, wherein said zinc coating chamber has an atmospheric gas temperature of a temperature to 250° C.

41. The method as claimed in claim 33, wherein said zinc coating chamber has an atmospheric gas temperature of a temperature to 250° C.

42. The method as claimed in claim 34, wherein said zinc coating chamber has an atmospheric gas temperature of a temperature to 250° C.

43. The method as claimed in claim 31, wherein after being zinc-coated in said zinc coating chamber, the steel sheet is cooled by spouting water through a nozzle.

44. The method as claimed in claim 33, wherein after being zinc-coated in said zinc coating chamber, the steel sheet is cooled by spouting water through a nozzle.

45. The method as claimed in claim 34, wherein after being reheated, the reheated steel sheet is cooled by spouting water through a nozzle.

46. The method as claimed in claim 31, wherein after being zinc-coated in said zinc coating chamber, the steel sheet is washed by water.

47. The method as claimed in claim 33, wherein after being zinc-coated in said zinc coating chamber, the steel sheet is washed by water.

48. The method as claimed in claim 34, wherein after being reheated, the reheated steel sheet is washed by water.

49. The method as claimed in claim 32, wherein the zinc powders contain Al in an amount of 0.1~0.7 wt %.

50. The method as claimed in claim 32, wherein the steel sheet is grounded, and said electrode is supplied with a voltage of −1~−100 KV, or 1~100 KV.

51. The method as claimed in claim 35, wherein the steel sheet is grounded, and said electrode is supplied with a voltage of −1~−100 KV, or 1~100 KV.

52. The method as claimed in claim 36, wherein the steel sheet is grounded, and said electrode is supplied with a voltage of −1~−100 KV, or 1~100 KV.

53. The method as claimed in claim 35, wherein said zinc coating chamber has an atmospheric gas temperature of a temperature to 250° C.

54. The method as claimed in claim 36, wherein said zinc coating chamber has an atmospheric gas temperature of a temperature to 250° C.

* * * * *

UNITED STATES PATENT AND TRADEMARK OFFICE

CERTIFICATE OF CORRECTION

PATENT NO. : 6,042,892
DATED : March 28, 2000
INVENTOR(S) : Sang Hean Kim et al.

It is certified that error appears in the above-identified patent and that said Letters Patent is hereby corrected as shown below:

Title page,
[56] References Cited, U.S. PATENT DOCUMENTS, third reference: "Campian et al." should read -- Campion et al. --.

Column 2,
Line 20, "pouted" should read -- spouted --.
Line 20, "into-the" should read -- into the --.

Column 13,
Line 7, after "studied" delete "on".
Line 52, "slate" should read -- state --.

Column 14,
Line 13, "lose" should read -- loses --.
Line 40, "nd therefore" should read -- and therefore --.

Column 15,
Line 37, after "electrode," insert -- -1 ~ --.

Column 23,
Line 28, "in. which" should read -- in which --.

Column 24,
Line 64, after "sheet" delete colon (:) and insert semicolon (;).

Column 25,
Line 10, "sheets" should read -- sheet, --.

Column 26,
Line 65, "in claim 15" should read -- in claim 19 --.

Column 27,
Line 43, "or 1~ -100KV." should read -- or 1~100KV. --.

UNITED STATES PATENT AND TRADEMARK OFFICE

CERTIFICATE OF CORRECTION

PATENT NO. : 6,042,892
DATED : March 28, 2000
INVENTOR(S) : Sang Hean Kim et al.

It is certified that error appears in the above-identified patent and that said Letters Patent is hereby corrected as shown below:

Column 28,
Line 29, "0.1~0.7 wt %." should read -- 0.1-0.7 wt %. --.

Signed and Sealed this

Twenty-first Day of August, 2001

*Attest:*

Nicholas P. Godici

*Attesting Officer*

NICHOLAS P. GODICI
*Acting Director of the United States Patent and Trademark Office*